US008528621B2

(12) United States Patent
Murphy, Jr. et al.

(10) Patent No.: US 8,528,621 B2
(45) Date of Patent: Sep. 10, 2013

(54) SOLAR WINDOW SHADE

(75) Inventors: John A. Murphy, Jr., Phoenix, AZ (US); John A. Murphy, III, Phoenix, AZ (US)

(73) Assignee: Murphy-Farrell Development L.L.L.P., Phoenix, AZ (US)

( * ) Notice: Subject to any disclaimer, the term of this patent is extended or adjusted under 35 U.S.C. 154(b) by 0 days.

(21) Appl. No.: 13/364,020

(22) Filed: Feb. 1, 2012

(65) Prior Publication Data

US 2013/0192770 A1 Aug. 1, 2013

(51) Int. Cl.

| | |
|---|---|
| ***E05F 15/20*** | (2006.01) |
| ***E06B 7/08*** | (2006.01) |
| ***E06B 7/084*** | (2006.01) |
| ***E06B 7/094*** | (2006.01) |

(52) U.S. Cl.
USPC ..... 160/5; 49/74.1; 49/80.1

(58) Field of Classification Search
USPC ..... 160/1, 2, 218, 22, 45, 48, 5, 51, 58.1, 160/61, 59, 72, 81, 87, 911; 359/591–599; 49/21
See application file for complete search history.

(56) References Cited

U.S. PATENT DOCUMENTS

| | | | | |
|---|---|---|---|---|
| 169,502 | A | | 11/1875 | Widemann |
| 2,068,148 | A | * | 1/1937 | Moir ..... 49/77.1 |
| 2,242,697 | A | | 4/1941 | Duca |
| 2,301,568 | A | | 11/1942 | Moss |
| 2,339,878 | A | | 1/1944 | Reid et al. |
| 2,433,583 | A | * | 12/1947 | Thurman ..... 160/60 |
| 2,654,425 | A | | 10/1953 | Hayner |
| 2,749,581 | A | | 6/1956 | McCormick |
| 2,791,009 | A | | 5/1957 | Wagner |
| 2,882,563 | A | | 4/1959 | McCormick |
| 2,917,795 | A | | 12/1959 | Brown |
| 3,011,225 | A | * | 12/1961 | Alfred ..... 49/82.1 |
| 3,039,155 | A | | 6/1962 | Iacovoni |
| 3,177,367 | A | | 4/1965 | Brown |
| 3,768,754 | A | * | 10/1973 | Janes ..... 244/171.8 |
| 3,884,414 | A | | 5/1975 | Baer |
| 3,917,942 | A | | 11/1975 | McCay |
| 4,022,186 | A | | 5/1977 | Northrup, Jr. |
| 4,054,125 | A | | 10/1977 | Eckels |
| 4,159,710 | A | * | 7/1979 | Prast ..... 126/582 |
| 4,205,659 | A | | 6/1980 | Beam |
| 4,217,884 | A | | 8/1980 | Strong |
| 4,220,137 | A | | 9/1980 | Tesch et al. |
| 4,279,240 | A | | 7/1981 | Artusy |
| 4,369,828 | A | | 1/1983 | Tatro |
| 4,401,103 | A | | 8/1983 | Thompson |

(Continued)

*Primary Examiner* — Katherine Mitchell
*Assistant Examiner* — Jeremy Ramsey
(74) *Attorney, Agent, or Firm* — Cahill Glazer PLC

(57) ABSTRACT

A solar window shade includes a frame for supporting louvers for shading at least one window of a building. Preferably, the frame is pivotally connected to the building above the window, and a frame drive system selectively pivots the frame upwardly or downwardly in accordance with the elevation of the sun. A louver drive system rotates the louvers within the frame to track east-to-west movements of the sun. The louvers are preferably provided as outer and inner louvers interlaced with each other, and such louvers nest with one another when the sun is hidden, or approaches from an acute angle, to maximize passage of indirect light rays to light the interior, while minimizing obstruction of the view through the window. The device is modular and is easily applied to aligned rows of windows and/or windows on multi-story buildings, with central control of the associated frame drive and louver drive systems.

63 Claims, 12 Drawing Sheets

(56) References Cited

U.S. PATENT DOCUMENTS

| | | | | |
|---|---|---|---|---|
| 4,449,563 | A | 5/1984 | Toda et al. | |
| 4,505,255 | A | 3/1985 | Baer | |
| 4,509,825 | A | 4/1985 | Otto et al. | |
| 4,517,960 | A | 5/1985 | Bartenbach | |
| 4,773,733 | A | 9/1988 | Murphy, Jr. et al. | |
| 5,204,777 | A | 4/1993 | Curshod | |
| 5,221,363 | A | 6/1993 | Gillard | |
| 5,714,751 | A | 2/1998 | Chen | |
| 5,873,202 | A | 2/1999 | Parks | |
| 6,421,966 | B1 | 7/2002 | Braunstein et al. | |
| 7,234,501 | B1 | 6/2007 | Park | |
| 7,417,397 | B2 | 8/2008 | Berman et al. | |
| 7,745,723 | B2 | 6/2010 | Dyson et al. | |
| 7,795,568 | B2 | 9/2010 | Sherman | |
| 2007/0056579 | A1 | 3/2007 | Straka | |
| 2008/0032100 | A1* | 2/2008 | Tsukuda et al. | 428/212 |
| 2009/0020233 | A1 | 1/2009 | Berman et al. | |
| 2009/0254222 | A1 | 10/2009 | Berman et al. | |
| 2011/0088324 | A1 | 4/2011 | Wessel | |
| 2011/0198041 | A1* | 8/2011 | Svirsky et al. | 160/61 |
| 2012/0180957 | A1* | 7/2012 | Svirsky | 160/59 |

* cited by examiner

SOLAR WINDOW SHADE

BACKGROUND OF THE INVENTION

1. Field of the Invention

The present invention relates generally to devices for shading windows from sunlight, and more particularly, to an improved shading device which blocks direct sunlight while increasing passage of indirect light.

2. Description of the Related Art

Window blinds have long been available for reducing the harsh glare, and thermal heat, associated with the penetrating rays of the sun. For example, U.S. Pat. No. 169,502 to Widemann in the year 1875 discloses a venetian shade including a series of parallel slats for blocking direct rays of the sun. U.S. Pat. No. 2,749,581 issued to McCormick in 1956 discloses a form of vertical blinds wherein the louvers are disposed vertically.

Awning structures have also been used on the outside of buildings adjacent windows for controlling the passage of sunlight through the window. U.S. Pat. No. 2,242,697 issued to Duca in 1940 describes an awning, including a series of horizontal metal slats, that can either be lowered against the window to serve as a storm blind or raised at an angle to the window to function as a conventional awning. The awning panel includes louvers that rotate about horizontal axes for selecting how much light to admit through the window. The awning frame also pivots about a horizontal axis from just above the top of the window, and an adjustable extension rod allows a user to set the angle of the awning relative to the window. U.S. Pat. No. 2,339,878 to Reid, et al., also discloses an awning structure in which the frame can swing relative to the window, and wherein the horizontal slats can be moved between opened and closed positions. U.S. Pat. No. 6,421,966 issued to Braunstein, et al. discloses a louvered sunshade for shading window exteriors.

U.S. Pat. No. 2,301,568 to Moss discloses the use of sliding slatted shutter panels on be rolled in front of the window, or, alternatively, to the side of the window.

U.S. Pat. No. 2,654,425 to Hayner discloses a metal awning that, in one embodiment (see FIGS. 5, 6 and 10) has louvers that can be drawn to opposing sides of the awning frame or extended across the awning frame. Hayner's awning frame maintains a fixed angular relationship with the window adjacent thereto. In U.S. Pat. No. 2,791,009 to Wagner, a louver type awning is disclosed wherein the louvers themselves can be rotated about their horizontal axes, but wherein the awning frame itself is fixed relative to the window.

Some shade device developers have attempted to provide louvered shading devices which are responsive to the position and/or intensity of the sun. For example, U.S. Pat. Nos. 2,917,795 and 3,177,367, both issued to Brown, disclose light passage louvers for a window along with a control apparatus for controlling the rotation of such louvers in response to the position of the sun. U.S. Pat. No. 3,917,942 to McCay likewise discloses a sun tracking control system for regulating the position of shading vanes. Likewise, U.S. Pat. No. 4,505,255 to Baer discloses a solar actuated louver system wherein a control apparatus responsive to movement of the sun controls the rotation of parallel louvers that either block or admit direct sunlight, depending upon the season.

Awning structures that include more than one bank of louvers are also known. For example, U.S. Pat. No. 5,873,202 to Parks discloses an embodiment of an awning-type structure that includes three sets of louvers; a center louver set is fixed in position, while the surrounding outer and inner louver sets are slidably movable under manual control to vary the amount of light passed.

Solar collection systems are also known using two or more sets of louvers. In U.S. Pat. No. 4,279,240 to Artusy, a solar collector window device is disclosed for controlling passage of solar radiation and which includes a series of outer reflective planar vanes plus a series of inner insulating planar panels. The inner insulating panels are provided to prevent heat loss from inside a building when the sun is not present. The outer reflective vanes may be rotated synchronously with each other, and the inner insulating panels may be rotated synchronously with each other. A control mechanism is also disclosed for controlling the angle of inclination of the outer vanes and inner vanes. In U.S. Pat. No. 4,220,137 to Tesch, et al., a solar energy collection system is disclosed wherein two sets of louvers are mounted in a window structure. The first set of outer louvers is mounted vertically and serve to reflect radiation from the sun toward the inside of the room; these outer louver are rotated about their vertical axes to follow movements of the sun. The second set of inner louvers are mounted horizontally and reflect radiation from the sun onto a solar collector; these inner louvers may also be rotated about their horizontal axes to follow movements of the sun.

While those skilled in the art have proposed a number of different shade devices for blocking the passage of excess sunlight through a window, the majority of such prior attempts are inefficient and/or objectionable. For example, while some known shade devices may be effective in blocking the passage of sunlight through a window into the interior space of a home or commercial building, they also interfere with an occupant's view through the window. Other known shade devices may likewise be effective at blocking passage of direct rays of sunlight into a building, but also block indirect light that could be used to help illuminate the interior space, and thereby reduce amounts spent for lighting the interior space. Still other known shade devices may be effective at shading direct sunlight during certain hours of the day, or during certain seasons of the year, but lose their effectiveness during the remaining hours of the day, or during the remaining seasons of the year. Other known shade devices require extensive modification of existing windows within a building, or are otherwise complex and expensive.

Accordingly, it is an object of the present invention to provide a shade apparatus for shading a window of a building from the sun which effectively shades direct rays of the sun from passing into a window while minimizing interference of an occupant's view of the exterior through such window.

Another object of the present invention is to provide such a shade apparatus which maximizes passage of indirect ambient light through the window, to help illuminate the interior space, while simultaneously blocking out direct rays of the sun.

Still another object of the present invention is to provide such a shade apparatus capable of effectively shading direct sunlight from entering through the building window during substantially all hours of the day, and during substantially all seasons of the year, while nonetheless maximizing the passage of indirect light through such window.

Yet another object of the present invention is to provide such a shade apparatus which is relatively simple and inexpensive, and which does not require modification of windows already existing in a building.

A further object of the present invention is to provide such a shade apparatus which may be assembled in modular form to synchronously shade a significant number of windows in a relatively large commercial building.

A still further object of the present invention is to provide such a shade apparatus which may simultaneously generate clean electrical power by maintaining associated photovoltaic panels oriented directly toward the sun during substantially all daylight hours.

These and other objects of the present invention will become more apparent to those skilled in the art as the description of the present invention proceeds.

SUMMARY OF THE INVENTION

Briefly described, and in accordance with one preferred embodiment thereof, the present invention relates to an apparatus for shading windows of a building from the sun, and including an awning frame pivotally connected at one of its ends to the exterior of the building; the awning frame pivots about a substantially horizontal axis above the top of the window. A frame drive system is supported by the building and is coupled to the awning frame to selectively cause the opposing second end of the awning frame to pivot upwardly or downwardly in accordance with the position of the sun. A number of rotatable louvers are supported at the second end of the awning frame; a louver drive system is supported, at least in part, by the awning frame for selectively rotating the louvers in accordance with the position of the sun. In this embodiment, the pivotal movement of the awning frame, and the rotation of the louvers, tracks daily and seasonal movements of the sun to block direct rays of sunlight, while maximizing passage of indirect light rays for lighting the interior of the building.

Preferably, each louver has a longitudinal panel axis, and the longitudinal panel axes of the louvers are arranged to be substantially parallel to each other. In addition, each of such louvers is supported for rotation relative to the awning frame about a pivot axis, and the pivot axes of the louvers are arranged substantially parallel to each other, and substantially parallel to the longitudinal panel axes. In turn, the longitudinal panel axes of the louvers preferably extend substantially perpendicular to the pivot axis of the awning frame.

In the preferred embodiment, the aforementioned louvers are provided as two groups of louvers, i.e., a first group of inner louvers and a second group of outer louvers, wherein the inner louvers are generally disposed closer to the window than the outer louvers. Preferably, all of the inner louvers and outer louvers are of the same width. Ideally, the inner and outer louvers are rotatably supported at the second end of the awning frame in alternating positions, i.e., interlaced with each other, to provide a staggered configuration. Preferably, the pivot axes of all of the inner louvers substantially lie within a common plane. Likewise, the pivot axes of all of the outer louvers also preferably lie within a common plane. In the preferred embodiment, the pivot axes of the inner louvers and the outer louvers all lie substantially within the same plane as each other. The pivot axis of a particular inner louver is preferably spaced equidistant from the pivot axes of the two adjacent outer louvers that surround such inner louver.

The frame drive system used to raise and lower the awning frame preferably includes a threaded rod threadedly engaged by the second end of the awing frame. The frame drive system rotates the threaded rod in a first direction to pivot the second end of the awning frame upward; the threaded rod is rotated in the opposite direction to pivot the second end of the awning frame downward. The upper end of the threaded rod may be coupled to an output port of a right-angle gearbox; the input port of such right-angle gear box may, in turn, be coupled to a driveshaft rotatably supported upon the exterior of the building. Rotation of the driveshaft is translated by the gearbox into rotation of the threaded rod for raising or lowering the awning frame. Preferably, the aforementioned driveshaft is disposed above the window and extends generally parallel to the substantially horizontal pivot axis of the first awning frame.

The above-described frame drive system can be applied advantageously to drive two or more awning frames in conjunction with two or more windows of the building; these windows may be disposed side-by-side, or alternatively, may be located one above the other. For example, a second such awning frame may be pivotally supported in similar fashion proximate a second window on the same side of the building as are the first window and first awning frame. The above-described driveshaft can simply be extended to a second gearbox for rotating a second threaded rod, thereby raising and lowering the second awning frame in synchronization with the raising and lowering of the first awning frame. Thus, rotation of the driveshaft simultaneously pivots the first and second awning frames upwardly or downwardly.

The aforementioned louver drive system may also include a rotatable drive shaft mechanically coupled with the louvers in the awning frame to rotate the louvers about their pivot axes. In the preferred embodiment, the drive shaft used to control the louvers has a longitudinal axis that extends coaxially with the substantially horizontal pivot axis of the awing frame. Where a building includes a series of windows extending along one side thereof, this louver drive shaft can pass from one awning frame to the next for simultaneously rotating the louvers in each of the awning frames, particularly where such windows are arranged in side-by-side fashion.

If desired, the louvers may simply consist of opaque panels for blocking direct rays of the sun. In one preferred embodiment, the outer surface of one or more outer louvers includes a photovoltaic panel that generally faces away from the window, and toward the sun. In this manner, the louvers not only block direct rays of the sun from entering into the building, but also generate electrical power.

Alternatively, selected surfaces of the louvers may be made reflective. Those surfaces that generally face the window can then reflect indirect light back toward the window. Also, by making the outer surfaces of the inner louvers reflective, rays of light intercepted by such inner louvers can effectively be bounced off of the inner surfaces of the outer louvers back toward the window, particularly if the inner surfaces of the outer louvers are also reflective.

In alternate embodiments of the present invention, the frame which supports the louvers for rotation may be either fixed or pivotable. As before, the frame is coupled to the exterior of the building proximate to the window. In these alternate embodiments, the louvers are divided into outer louvers and inner louvers; the inner louvers are again disposed closer to the window than the outer louvers. A louver drive system is again supported, at least in part, by the frame, and coupled to the outer louvers and inner louvers for selectively rotating such louvers in accordance with the position of the sun. The outer louvers and inner louvers are preferably supported by the frame in alternating, interlaced positions to provide a staggered configuration of louvers. In cases where the frame does not pivot up or down, but remains in a fixed position relative to the window, the outer louvers and inner louvers are supported by the frame for rotation about substantially parallel axes; these parallel axes need not be oriented vertically. In addition, in the case of a fixed frame installation, the frame and its associated louvers may be extended vertically to cover two or more windows positioned on two or more floors of a multiple story building.

As described earlier, each outer louver includes an elongated panel having a longitudinal panel axis; likewise, each of the inner louvers includes an elongated panel having a longitudinal panel axis. In one preferred embodiment, each of the outer louvers is supported by an offset arm for rotational movement relative to the frame about a pivot axis; similarly, each of the inner louvers is supported by an offset arm for rotational movement relative to the frame about a pivot axis. The pivot axis of each outer louver is offset from its longitudinal panel axis by a first offset arm distance D1, and the pivot axis of each inner louver is offset from its longitudinal panel axis in the opposite direction by a second offset arm distance D2. If desired, the pivot axes of the outer louvers and the pivot axes of the inner louvers may all lie in a common plane.

The pivot axis of each inner louver is located substantially between the pivot axes of adjacent preceding and succeeding outer louvers; the pivot axis of each inner louver is separated from the pivot axes of the adjacent preceding and succeeding outer louvers by separation distance S. It follows that the separation distance between the pivot axes of two successive outer louvers is twice the value of S, and that the separation distance between the pivot axes of two successive inner louvers is also twice the value of S.

To maximize blockage of incoming direct rays of the sun while maximizing passage of indirect light into the window, the sum of the first offset arm distance D1 and the second offset arm distance D2 is preferably greater than the aforementioned separation distance S. Ideally, the sum of D1 and D2 only slightly exceeds distance S to minimize interference between adjacent louvers when the sun is incident from a sharp angle relative to the window. To simplify construction, D1 and D2 are preferably equal to each other. However, it is also possible to reduce one of such offsets effectively to zero, e.g., by making the pivot axes of the outer louvers coincident with the longitudinal panel axes of such outer louvers (hence, D1 equals zero), and increasing the offset arm distance D2 for the inner louvers to be slightly in excess of separation distance S. Alternatively, it is possible to make the pivot axes of the inner louvers coincident with the longitudinal panel axes of such inner louvers (hence, D2 equals zero), and to increase the offset arm distance D1 for the outer louvers to be slightly in excess of separation distance S.

As before, the width of the outer louvers and the width of the inner louvers is preferably kept constant at value W to maximize the view. To insure blockage of direct rays of the sun, width W is preferably greater than the separation distance S which separates the pivot axis of each inner louver from the pivot axes of each of the adjacent preceding and succeeding outer louvers. It is preferred that width W only slightly exceed separation distance S to minimize interference between adjacent louvers when the sun is at a sharp angle relative to the window.

Alternatively, different widths W1 and W2 may be used for the outer louvers and inner louvers, respectively. In that case, the sum of the widths W1 and W2 is preferably greater than twice the separation distance S which separates the pivot axis of each inner louver from each of the pivot axes of the adjacent preceding and succeeding outer louvers. Again, it is preferred that the sum of the widths W1 and W2 only slightly exceed twice the value of separation distance S to avoid interference between adjacent louvers.

In one preferred embodiment of the invention, the louver drive system rotates the inner louvers and outer louvers synchronously, and by the same amount. In other words, if the louver drive system is operated to rotate the outer louvers in a clockwise direction by 10 degrees, then the inner louvers are also rotated in a clockwise direction by 10 degrees. If desired, however, the louver drive system may include asynchronous gearing, causing the inner louvers to rotate asynchronously relative to the outer louvers. For example, the louver drive system may rotate the outer louvers in a clockwise direction by 10 degrees, but only rotate the inner louvers in a clockwise direction by 5 degrees.

As was true of the earlier-described embodiments, a photovoltaic panel may be provided upon the outer surface of one or more of the outer louvers, generally facing away from the window of the building, to generate electrical power. As was also described earlier, the outer and inner louvers may have selective surfaces that maximize the diffuse light within the visible spectrum which is reflected into the window while reducing the maximum temperature attained by the louvers and minimizing the amount of light within the infrared spectrum that radiates toward the window.

DETAILED DESCRIPTION OF THE PREFERRED EMBODIMENT

Figure 1:
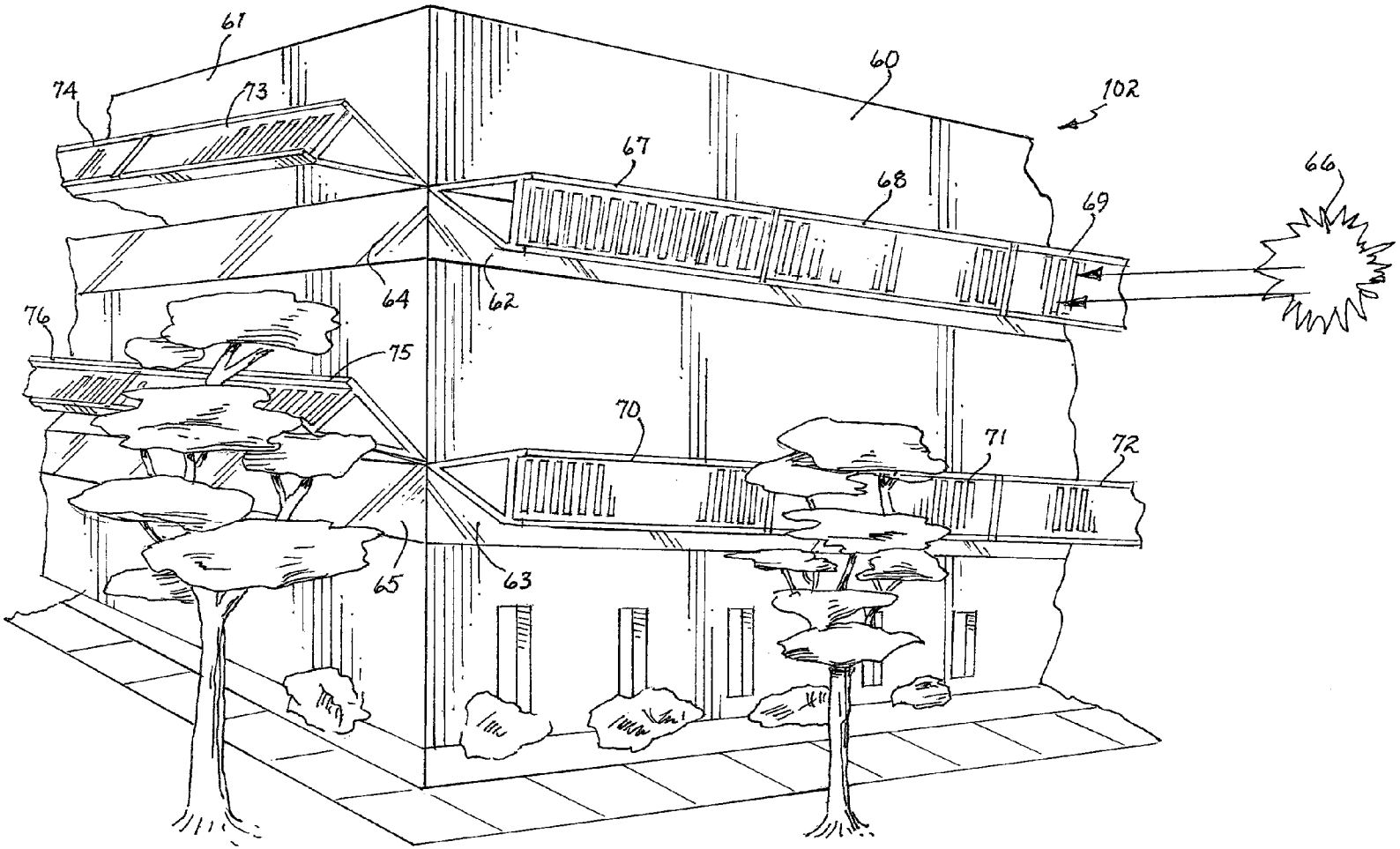
FIG. 1 is a perspective view of a two-story building, having two bands of windows encircling the building, wherein the windows are shaded by solar shade devices in accordance with a preferred embodiment of the present invention.

In FIG. 1, a multiple-story building 102 includes a southerly-facing wall 60 and a westerly-facing wall 61. Building 102 includes, of course, northern and eastern walls, not shown in FIG. 1. Wall 60 includes upper and lower banks of windows 62 and 63, respectively. Likewise, wall 61 includes upper and lower banks of windows 64 and 65, respectively. The sun's rays 66 are shown low in the eastern morning sky.

Installed upon the exterior of wall 60 are a series of solar window shades, constructed in accordance with the present invention. The upper bank of windows 62 is shaded by solar window shades 67, 68, and 69, while the lower bank of windows 63 is shaded by solar window shades 70, 71, and 72. All of the solar window shades 67-72 are shown pivoted downwardly to approximately the same height as their associated windows to block direct rays of incident light from the early morning sun.

Similarly, solar window shades 73 and 74 are installed proximate upper window 64 of wall 61, and solar window shades 75 and 76 are installed proximate lower window 65 of wall 61. All of the solar window shades 73-76 are shown pivoted upwardly above their associated windows since it is too early in the day for direct rays of sunlight to strike westerly-facing windows 64 and 65.

Figure 2:
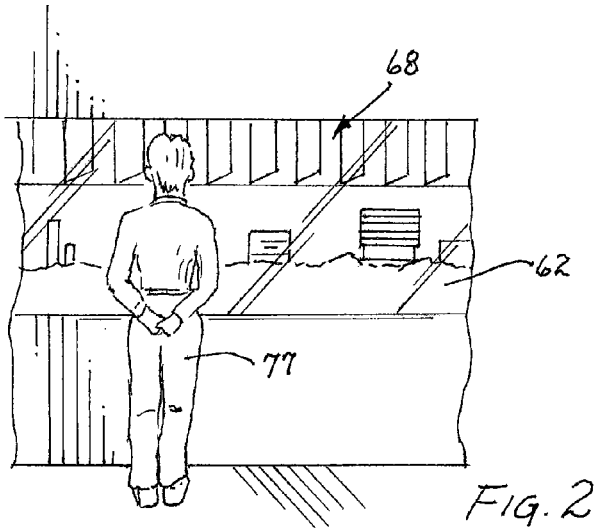
FIG. 2 is a view of the interior space of the building in FIG. 1, looking toward a shaded window.

FIG. 2 illustrates occupant 77 looking outwardly through window 62 from inside building 102. In this view, shade device 68 has pivoted further upwardly, as the sun has risen to a mid-morning position. Occupant 77 has a clear view of the outdoors through the lower two-thirds of window 62. Louvered shade device blocks a portion of the upper third of window 62, but occupant 77 still has a view through gaps formed between such louvers.

Figure 3:
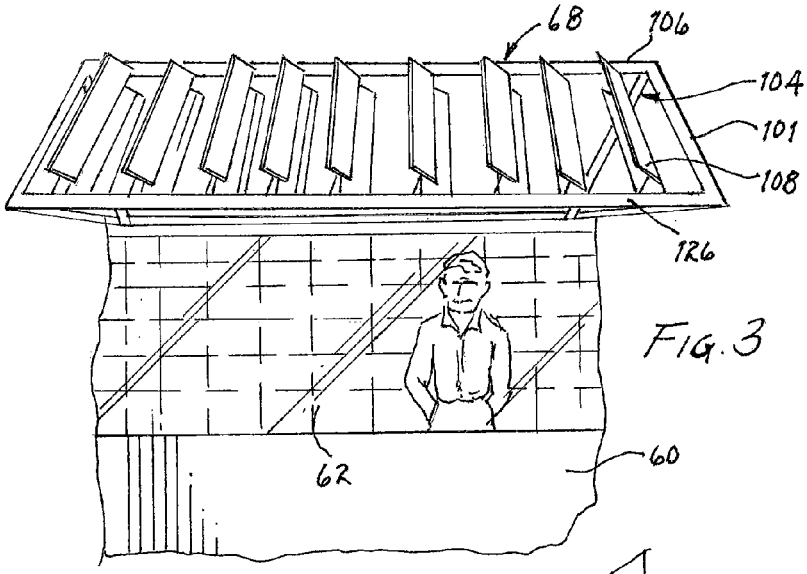
FIG. 3 is a perspective view of the same window shown in FIG. 2 but viewed from the exterior of the building.
Figure 4:
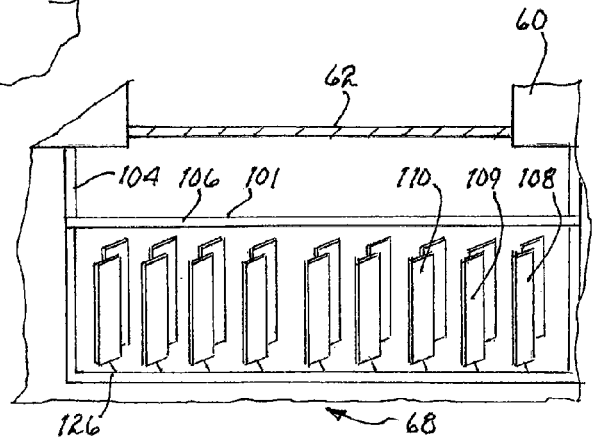
FIG. 4 is a top view of the shade device shown in FIG. 3.

FIG. 3 is a view looking toward occupant 77, through window 62, from the exterior of building 102. Shade device 68 includes a generally rectangular awning frame 101 which supports a series of rotatable louvers. If desired, rectangular frame 101 may have a length which extends the full length of the window to be shaded. However, if building 102 includes long, continuous banks of windows, then it is more practical to install two or more of such shade devices side-by side. Rectangular frame 101 includes a top upper horizontal rail 106 and a bottom horizontal rail 126. The height of rectangular frame 101, i.e., the distance between top rail 106 and bottom rail 126, slightly exceeds the length of the louvers supported therein, and approximates the height of the window to be protected from the direct rays of the sun.

Figure 5:
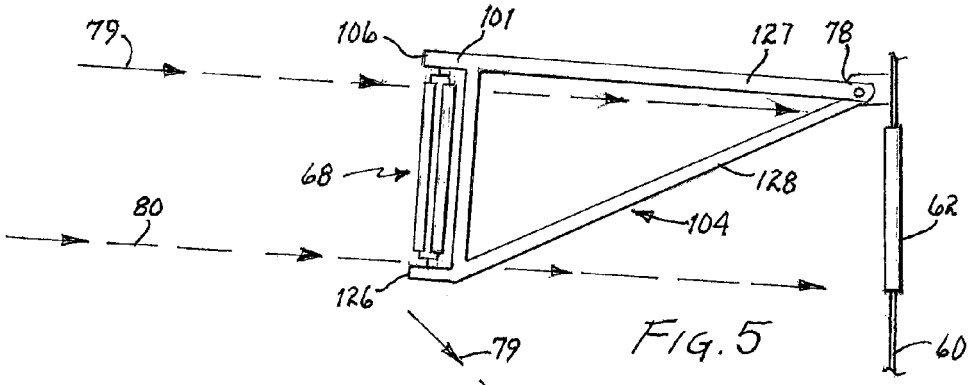
FIG. 5 is a side view of the shade device lowered to face the sun when the sun is relatively low on the horizon.
Figure 6:
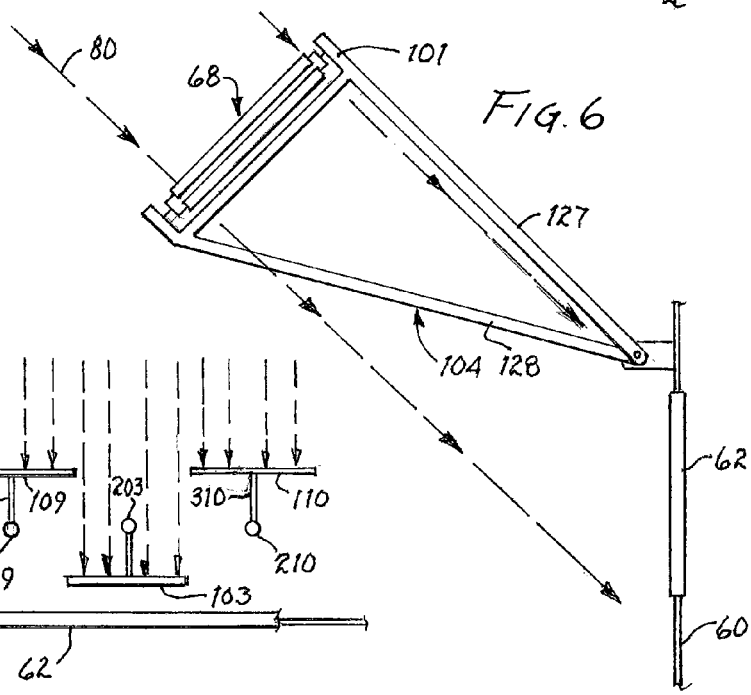
FIG. 6 is a side view of the shade device, similar to FIG. 5, but raised to face the sun when the sun is higher in the sky.

Rectangular Frame 101 is supported at each of its ends by a generally triangular frame 104. As shown in FIGS. 5 and 6, triangular frame 104 includes an upper connecting leg 127 and a lower connecting leg 128. Upper connecting leg 127 has one of its ends attached to the top of rectangular frame 101 along one side thereof, and lower connecting leg 128 has one of its ends attached to the bottom of rectangular frame 101 along the same side thereof. The opposite ends of connecting legs 127 and 128 are connected to each other at pivot axis 78 for being pivotally supported from exterior wall 60 slightly above window 62. This collective awning frame pivots about a substantially horizontal axis proximate to the top of window 62; awning frame pivot axis 78 lies parallel to the window being shaded. Connecting legs 127 and 128 extend substantially perpendicular to awning frame pivot axis 78.

In addition, connecting leg 127 preferably extends generally perpendicular to the plane defined by rectangular frame 101, although this angle may be adjusted to account for variations in the distance between the top of window 62 and pivot axis 78. The triangular frames 104 support rectangular frame 101 so that top rail 106 and bottom rail 126 of rectangular frame 101 both extend substantially parallel to awning frame pivot axis 78. Preferably, rectangular frame 101 and each of the triangular frames 104 are formed of metal tubing; such metal tubing may be closed rectangular tubing or open C-channel stock. These preferred shapes may be modified, if desired, either for aesthetic reasons or to deter pigeons from roosting thereon.

FIG. 5 shows shade device 68 pivoted downwardly wherein the lower end of rectangular frame 101 is almost level with the bottom of window 62. This position would be desired, for example, for a window facing east, during early morning hours, when the sun is low in the sky. Incoming light rays 79 and 80 are blocked by the upper portions and lower portions, respectively, of the louvers, as are all incident light rays lying between rays 79 and 80. Accordingly, window 62 is completely shaded from direct rays of sunlight.

In FIG. 6, shade device 68 is shown pivoted upwardly wherein the lower end of rectangular frame 101 is actually above the top of window 62. This position would correspond to a southerly-facing window in the later morning hours, when the sun is at a higher elevation in the sky. Once again, incoming light rays 79 and 80 are blocked by the upper portions and lower portions, respectively, of the louvers, as are all incident light rays lying between rays 79 and 80.

Therefore, window 62 is again shaded from direct rays of the sun, as is a portion of wall 60 lying below window 62.

Within the preceding description, reference has been made to louvers rotatably supported within rectangular frame 101 of shade device 68. Turning to FIGS. 7-9 and 15-16, such louvers include those louvers designated by reference numerals 108, 109, and 110, as well as those louvers designated by reference numerals 111 and 103. Each of louvers 108, 109, 110, 111 and 103 has a central longitudinal axis about which it extends; the longitudinal axes of such louvers preferably extend parallel to each other. In addition, each of louvers 108, 109, 110, 111 and 103 is supported for rotation between top rail 106 and bottom rail 126 of rectangular frame 101 about its own pivot axis.

Figure 7:
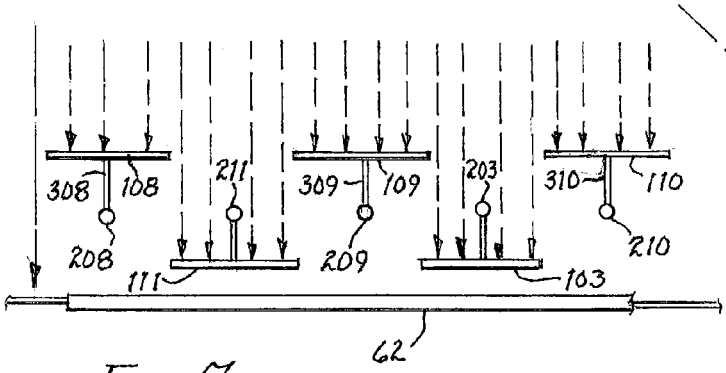
FIG. 7 is a top schematic view showing the position of outer louvers and inner louvers when the rays of the sun are essentially perpendicular to the plane of the window being shaded, e.g., a westerly-facing window in the late afternoon.

In the preferred embodiment illustrated in FIGS. 1-17, louvers 108, 109, 110, 111 and 103 are divided into two groups, i.e., outer louvers and inner louvers. The outer louvers include louvers 108, 109 and 110. The inner louvers include louvers 111 and 103, which are located closer to the window being shaded than the outer louvers 108, 109, and 110, as shown for example in FIG. 7. As is also illustrated in FIG. 7, inner louvers 111 and 103 are interlaced with outer louvers 108, 109, and 110 in alternating positions with each other to provide a staggered configuration of louvers. Typically, each inner louver lies proximate to two outer louvers. For example, intermediate inner louver 111 lies proximate to successive outer louvers 108 and 109.

Figure 8:
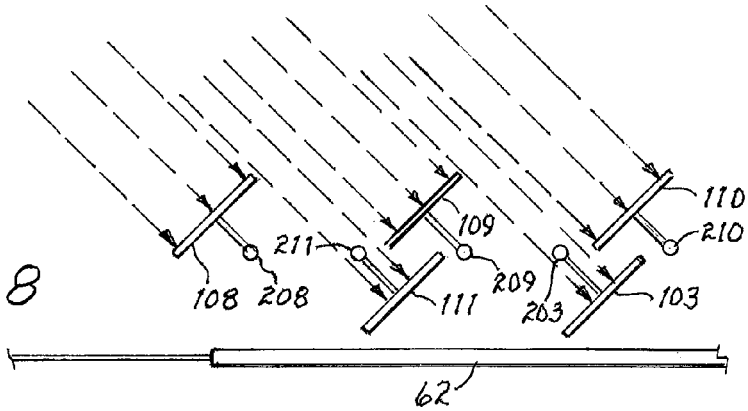
FIG. 8 is a top schematic view, similar to FIG. 7, and showing the position of the outer louvers and inner louvers when the rays of the sun are incident at approximately a 45-degree angle relative to the plane of the window being shaded, e.g., a southerly-facing window at mid-morning in the Northern Hemisphere.

Each of inner louvers 111 and 103 rotates about its own pivot axis; each such pivot axis extends substantially parallel to the central longitudinal axis of each such louver panel. In FIGS. 7 and 8, the pivot axis of inner louver 111 is designated as 211, and the pivot axis of inner louver 103 is designated as 203. Pivot axes 211 and 203 extend substantially parallel to each other and lie substantially within a common plane. Likewise, each of outer louvers 108, 109, and 110 rotates about its own pivot axis 208, 209, and 210, respectively. Pivot axes 208, 209, and 210 of outer louvers 108, 109, and 110 are substantially parallel to each other, and also lie substantially within a common plane. Further, in the preferred embodiment, the pivot axes 211 and 203 of the inner louvers, and the pivot axes 208, 209, and 210 of the outer louvers all lie substantially within the same plane.

As mentioned above, inner louvers 111 and 103 are interlaced with outer louvers 108, 109, and 110. Pivot axis 211 of inner louver 111 is preferably spaced equidistantly from pivot axes 208 and 209 of surrounding outer louvers 108 and 109. In other words, pivot axis 208 lies in a first plane that is substantially perpendicular to awning frame pivot axis 78; pivot axis 209 lies in a second plane that is substantially perpendicular to awning frame pivot axis 78; and pivot axis 211 lies in a third plane also substantially perpendicular to awning frame pivot axis 78. This third plane containing pivot axis 211 lies substantially midway between the first and second planes containing pivot axes 208 and 209.

Figure 15:
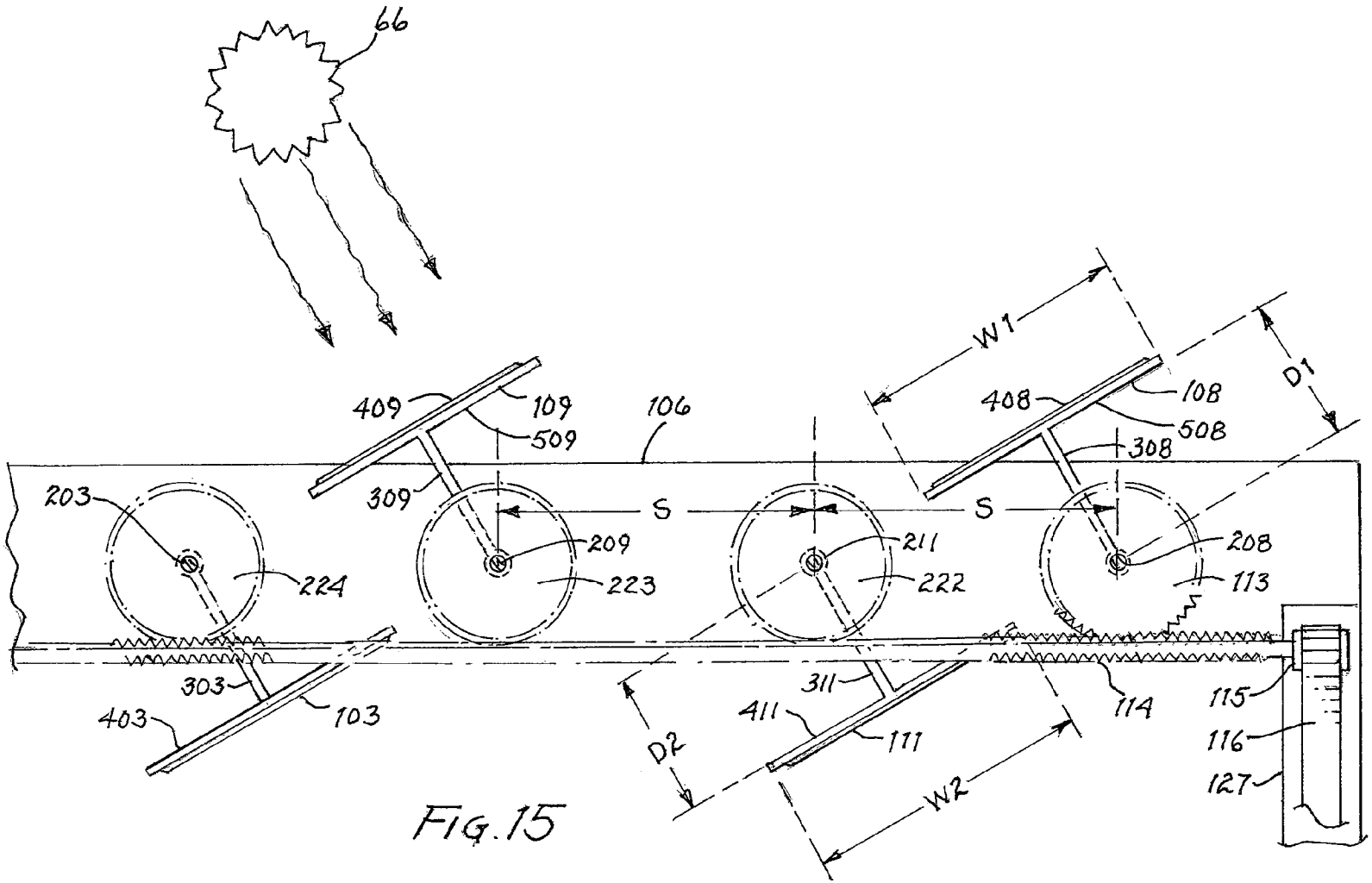
FIG. 15 is a sectional view taken through lines 15-15 in FIG. 9 and showing the threaded louver drive rod extending through the remote end of the awning frame for engaging the louver gears that rotate the offset arms used to support the upper ends of the louvers.

Referring briefly to FIG. 15, the width of outer louver is designated as W1; likewise, the width of inner louver 111 is shown as W2. In the embodiment illustrated in FIG. 15, W1 and W2 are equal to each other, although they may differ in other embodiments. As further shown best in FIG. 15, the central longitudinal axis of outer louver 108 is offset from its pivot axis 208 by an offset arm 308, which supports outer louver 108 for rotational movement relative to rectangular frame 101 about pivot axis 208. Offset arm 308 displaces outer louver 108 from its pivot axis 208 by offset distance D1. Similarly, the central longitudinal axis of inner louver 111 is offset from its pivot axis 211 by offset arm 311, which supports inner louver 111 for rotational movement relative to rectangular frame 101 about pivot axis 211; offset arm 311 displaces inner louver 111 from its pivot axis 211 by offset distance D2. In the embodiment illustrated in FIG. 15, D1 and D2 are equal to each other, although they may differ in other embodiments. While FIGS. 7 and 15 shows offset arms 303, 309, 308 and 311 as being directly coupled to the central longitudinal axes of louvers 103, 109, 108, and 111, respectively, those skilled in the art will appreciate that these offset arms could be secured to their respective louvers at other points, including one of the side edges of each such louver. For example, in FIGS. 23 and 24, offset arms 286 and 287 are secured to side edges of louvers 284 and 285 respectively. As used herein, the "offset distance" between the pivot axis and the central longitudinal axis of the louver generally designates the distance from the pivot axis to the plane containing such louver, whether the offset arm is actually attached to the central longitudinal axis of the louver or not.

Within FIG. 7, incident rays of direct sunlight are represented by dashed arrows directed toward window 62 approximately perpendicular thereto. All of such incident rays are intercepted by louvers 108, 109, 110, 111 and 103. Referring briefly to FIG. 2, assuming that the awning frame is fully-lowered to the level of window 62, and further assuming that the sun is approaching from the angle shown in FIG. 7, then such louvers would also block the direct view of occupant 77 of the outdoors along a line of sight perpendicular to window 62. Nonetheless, because the outer and inner louvers are staggered, and because such louvers are offset from their respective pivot axes, there are still large gaps of space between such louvers that permit viewing of the outdoors to the left, and to the right, of occupant 77. These same large gaps between the louvers also permit a significant amount of indirect sunlight to enter through window 62 without adding unwanted heat or glare.

Similarly, within FIG. 8, incident rays of direct sunlight are represented by dashed arrows, which are now directed at approximately a 45 degree angle to window 62. Once again, all of such incident rays of sunlight are intercepted by louvers 108, 109, 110, 111 and 103 before reaching window 62. Again assuming that the awning frame is fully-lowered to the level of window 62, and further assuming that the sun is approaching from the angle shown in FIG. 8, then such louvers permit occupant 77 (see FIG. 2) a partial view of the outdoors along a line of sight perpendicular to window 62; this partial view is greater in magnitude than that provided by typical vertical blinds under similar circumstances since adjacent outer louvers and inner louvers (e.g., outer louver 109 and inner louver 111) approach each other more closely. Once again, relatively large gaps of space between the louvers (e.g., the gap between outer louver 108 and inner louver 111) permit significant views of the outdoors straight ahead, and to the right, of occupant 77. These same large gaps between the louvers also permit a significant amount of indirect sunlight to enter through window 62 without adding unwanted heat or glare.

Still referring to FIG. 15, pivot axis 211 of inner louver 111 is separated from the pivot axes 208 and 209 of the adjacent preceding and succeeding outer louvers 108 and 109, respectively, by a separation distance S. It is advantageous to maintain a relationship between separation distance S and offset distances D1 and D2 to allow for nesting of the louvers as they are rotated. As shown in FIG. 8, inner louver 111 approaches outer louver 109 as the louvers are rotated to intercept sun rays approaching from an acute angle relative to the window being shaded. Continued rotation may actually bring such louvers and/or their associated offset arms into contact with each other. In order to permit such louvers to nest with each other, and minimize interference with each other, the sum of the first offset arm distance D1 and second offset arm distance D2 is preferably made slightly greater than the separation distance S.

Again referring to FIG. 15, it is advantageous to maintain a relationship between separation distance S and the widths W1 and W2 of the outer louvers and inner louvers, respectively, to ensure sufficient blockage of direct rays of the sun, while allowing for nesting of the louvers, and avoiding interference, as the louvers are rotated to intercept sun rays approaching from an acute angle relative to the window being shaded. Accordingly, in the case where all of the inner louvers and outer louvers have the same width W, then W is preferably kept slightly greater than separation distance S. Preferably, successive pivot axes 208 and 209 of successive outer louvers 108 and 109 are separated from each other by a distance that is slightly less than twice the louver width W; similarly, successive pivot axes 211 and 203 of successive inner louvers 111 and 103 are separated from each other by a distance that is slightly less than twice louver width W. Alternatively, if the width W1 of the outer louvers, and the width W2 of the inner louvers, differ from each other, then the sum of the widths W1 and W2 is preferably set to be slightly greater than twice the separation distance S.

Rectangular frame 101 and triangular frames 104 may collectively be regarded as an awning frame, one end of which is pivotally connected to the exterior of building 102 above window 62. Louvers 108, 109, 110, 111 and 103 are each rotatably supported proximate the opposite end of the awning frame.

Figure 10:
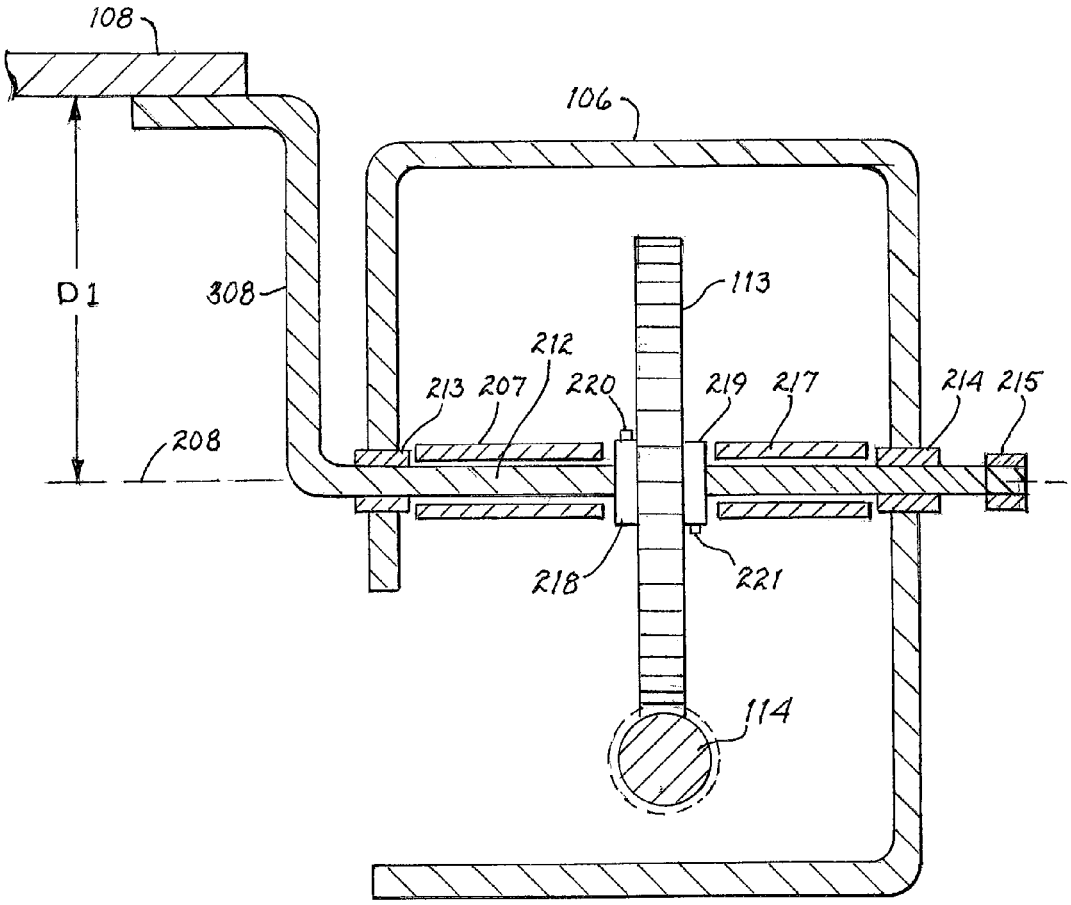
FIG. 10 is a sectional view, taken through lines 10-10 in FIG. 9, showing the engagement of a louver gear with a threaded louver drive rod for rotating the offset arm used to support the upper end of a louver.

In order to support the louvers along pivot axes offset from their respective longitudinal axes, a pair of offset arm rods are provided at the top and bottom of each such louver. Turning to FIG. 10, louver rod 212 is rotatably supported within top rail 106 of rectangular frame 101 by bushings 213 and 214 along pivot axis 208. One end of louver rod 212 has an end cap 215 secured thereto. The other end of louver rod 212 exits top rail 106 and undergoes a ninety-degree bend to form offset arm 308. Offset arm 308 also undergoes a ninety-degree bend before it attaches to the underside of outer louver 108. Louver rod 212, including offset arm 308, supports the upper end of louver 108 at an offset distance D1 from pivot axis 208. While not shown in FIG. 10, similar louver rods are used to pivotally support the upper ends of outer louvers 109 and 110. Likewise, similar louver rods are used to pivotally support the upper ends of inner louvers 111 and 103, except that offset arms 311 and 303 (see FIG. 15) are each 180 degrees out of phase with offset arm 308.

Still referring to FIG. 10, a threaded louver drive rod 114 is used to control the angular orientation of the outer louvers and inner louvers. As shown in FIG. 15, threaded louver drive rod 114 extends within top rail 106 of rectangular frame 1. Louver drive gear 113 includes a pair of opposing locking collars 218 and 219 for securing louver drive gear 113 onto louver rod 212 via fasteners 220 and 221, respectively. The peripheral portion of louver drive gear 113 meshes with threaded louver drive rod 114 to form a worm gear drive. As shown in FIG. 10, a pair of tubular spacing collars 207 and 217 extend about louver rod 212 on opposing sides of louver drive gear 113 to maintain louver drive gear 113 in proper lateral alignment with threaded louver drive rod 114. As threaded louver drive rod 114 rotates in either direction, louver driver gear 113 rotates accordingly, and outer louver 108 pivots as a result. As shown in FIG. 15, similar louver drive gears 222, 223 and 224 are also meshed with threaded louver drive rod 114 for pivoting louvers 111, 109, and 103, respectively.

Figure 16:
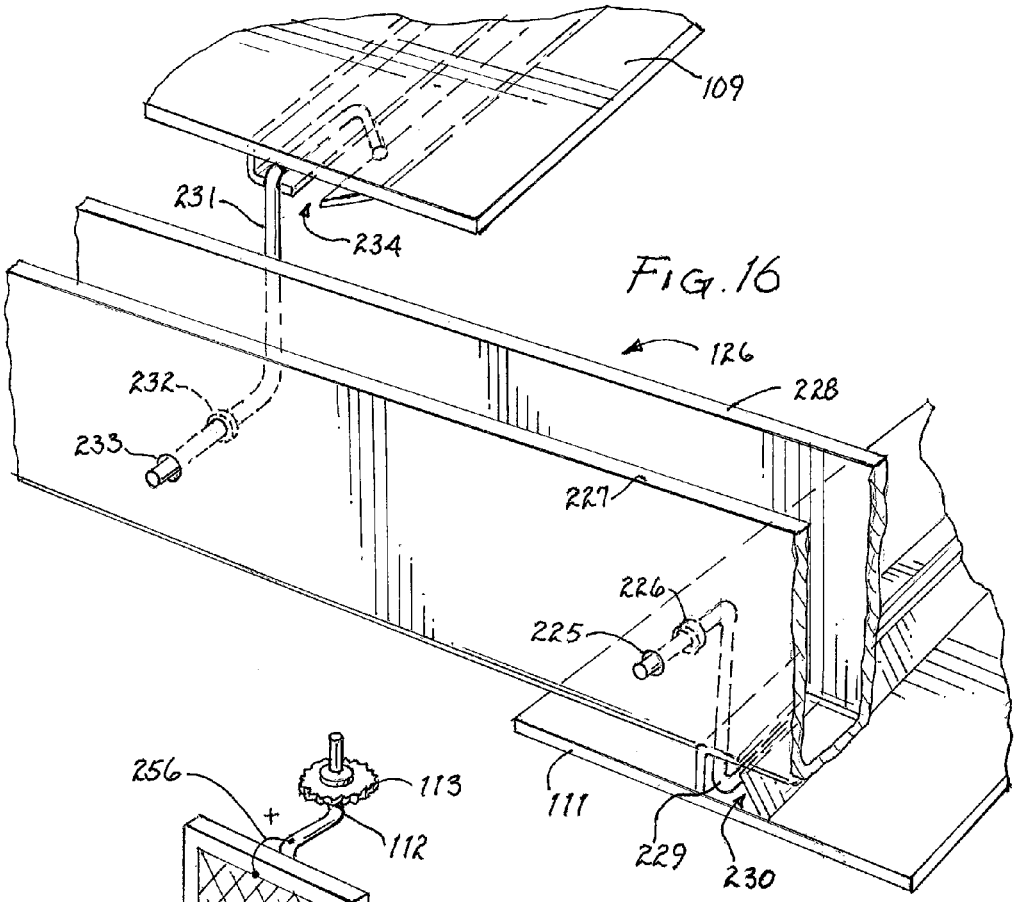
FIG. 16 is a perspective view of the idler offset arms which pivotally support the louvers at their lower ends.

The lower ends of each such louver are preferably supported by idler offset arms in a manner similar to that of the upper ends of such louvers, except that the idler offset arms used to pivotally support the lower ends of the louvers are not powered, but merely space such lower ends at the desired offset distance from the pivot axis of such louver. Referring to FIG. 16, lower rail 126 of rectangular frame 101 is shown as being made of C-channel stock. A pair of aligned holes 225 and 226 are formed in parallel walls 227 and 228, respectively, for rotatably supporting one end of idler offset arm 229; the end of idler offset arm 229 protruding from hole 225 may include a retaining end cap, if desired. After exiting hole 226, idler offset arm 229 undergoes a ninety-degree bend, and extends for offset distance D2 (see FIG. 15) before undergoing another ninety-degree bend. The terminal portion of idler offset arm 229 is attached to the lower end of inner louver 111; pocket 230 may be formed upon the upper side of louver 111 for such purpose. A similar idler offset arm 231 has one end rotatably supported by aligned holes 232 and 233. The opposite end of idler offset arm 231 is attached to the underside of upper louver 109, as by pocket 234. Idler offset arm 231 spaces outer louver 109 by offset distance D1 from the pivot axis formed by holes 232 and 233. However, as shown in FIG. 16, idler offset arm 231 extends 180 degrees out of phase with idler offset arm 229. As noted above, offset distances D1 and D2 may be equal to each other.

Figure 9:
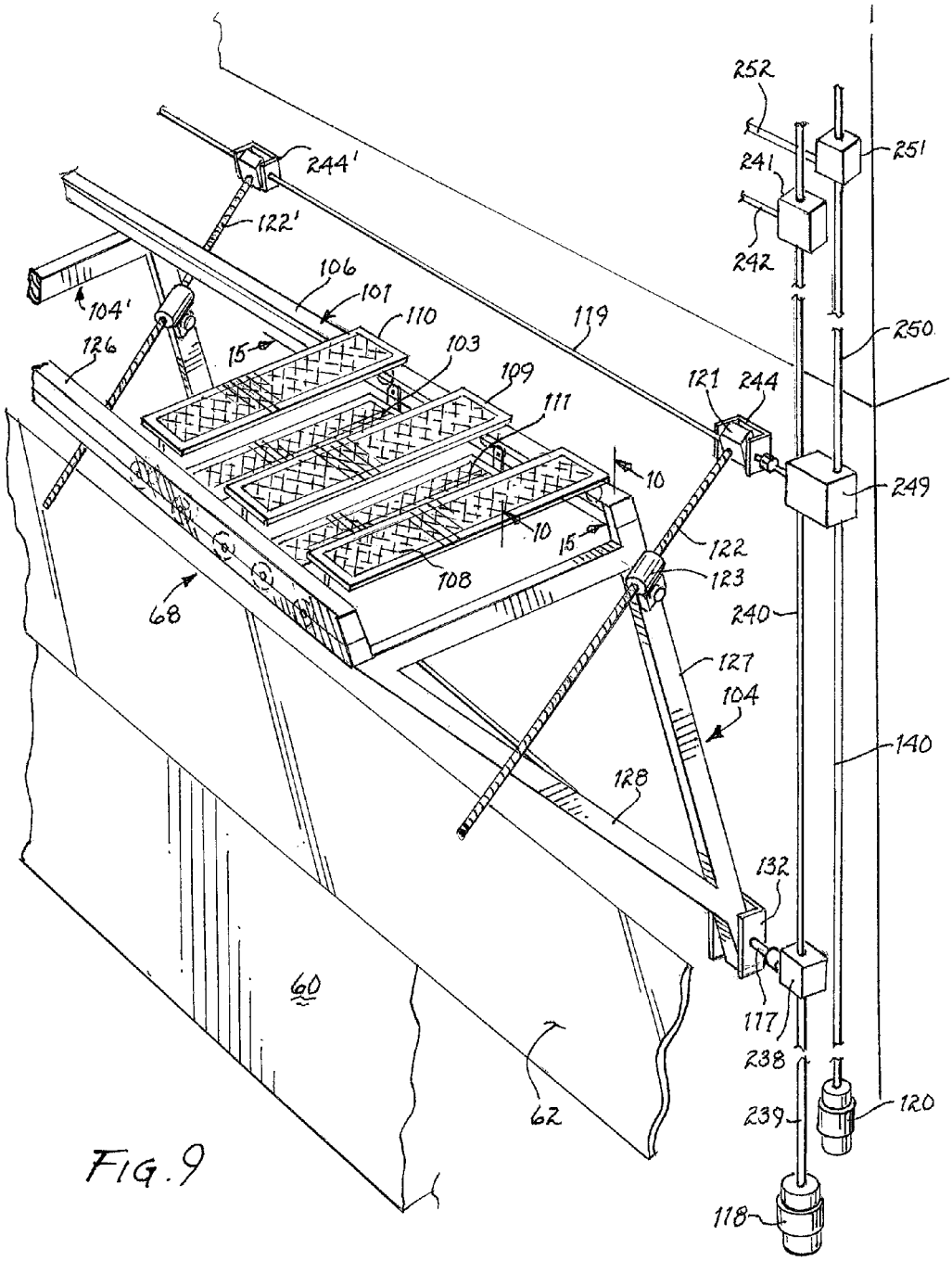
FIG. 9 is a perspective view of the shade device, including the frame drive system and the louver drive system.
Figure 12:
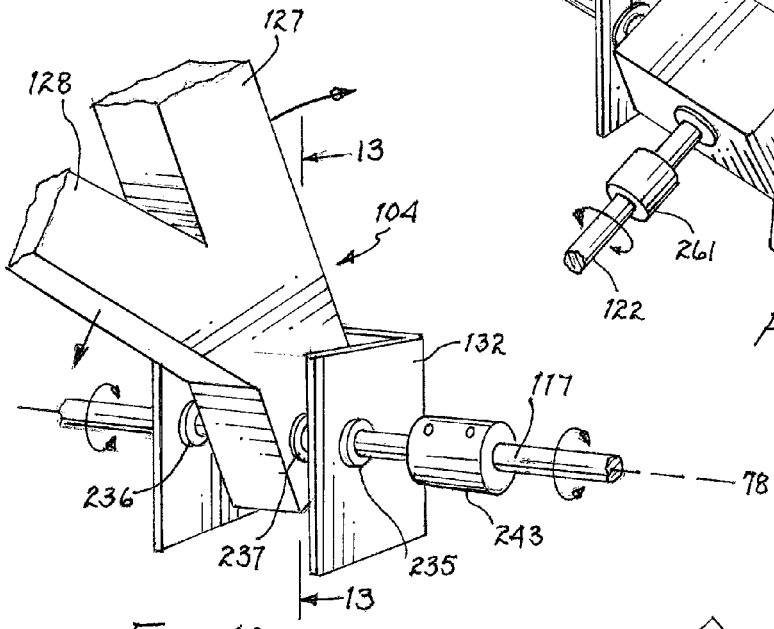
FIG. 12 is a detailed perspective view of the pivot axis of the awning frame coaxially aligned with a louver drive shaft.

As noted above, threaded louver drive rod 114 is used to control the angular orientation of the louvers. In regard to FIGS. 14 and 15, threaded louver drive rod 114 ("the worm") is secured at one of its ends to a toothed pulley 115 over which a toothed belt 116 is engaged. Toothed pulley 115 is housed within the upper end of connecting arm 127 of triangular frame 104. Toothed belt 116 extends through connecting arm 127 back toward building 102. As shown in FIG. 12, the lower ends of connecting arms 127 and 128 are joined to each other at the lower end, or "building end", of triangular frame 104. In order to support shade device 68 for pivotal movement from exterior wall 60 of building 102, at least two angle brackets, like that shown as 132 in FIGS. 9 and 12, are secured to wall 60 on each side of shade device 68. Bushings 235 and 236 are provided in aligned holes formed in the opposing parallel walls of bracket 132 for rotatably supporting a louver drive shaft 117. In turn, the lower end of triangular frame 104 has a pair of bushings, including bushing 237, provided within mating holes formed therein for receiving louver drive shaft 117. Accordingly, the lower ends of triangular frames 104, and hence, shade device 68, are pivotally supported to building 102 via bushings 235, 236, and 237; louver drive shaft 117; and bracket 132. In this regard, louver drive shaft 117 is coincident with the horizontal pivot axis 78 of shade device 68.

Figure 13:
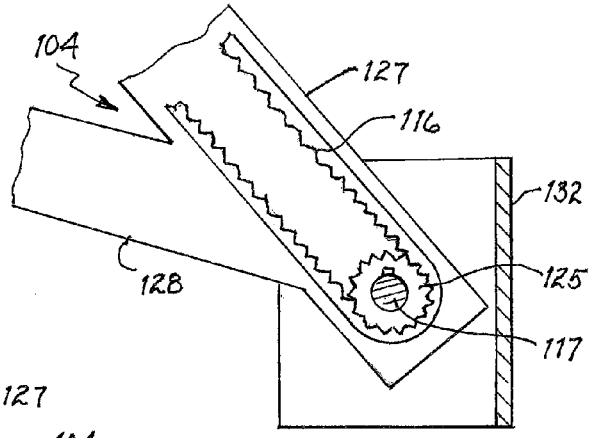
FIG. 13 is a sectional view taken through lines 13-13 in FIG. 12, and showing a lower toothed gear secured to the louver drive shaft for rotating the lower end of a louver drive belt.
Figure 14:
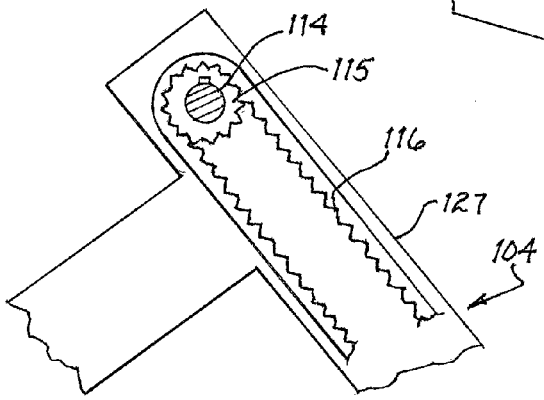
FIG. 14 is a sectional view of the remote end of the awning frame, and showing the louver drive belt of FIG. 13 engaged with an upper toothed gear secured to the threaded louver drive rod of FIG. 10.

Within the sectional view of the lower end of triangular frame 104 shown in FIG. 13, a toothed pulley 125 is secured over louver drive shaft 117 within the lower end of connecting arm 127. Toothed belt 116, described earlier in conjunction with FIG. 14, is engaged over toothed pulley 125 on louver drive shaft 117. Referring to FIG. 9, louver drive shaft 117 is coupled, through a right-angle gear box 238 to a master vertical louver drive shaft 239 and to reversible electric motor 118. It will be noted that, if desired, a master vertical louver drive shaft extension 240 may extend upwardly from gear box 238 for driving another gear box 241, and that another louver drive shaft 242 may extend from gear box 241 for controlling rotation of louvers within shade devices installed to shade windows for a floor above.

Summarizing the louver drive system, reversible motor 118 rotates louver drive shaft 117, which rotates lower toothed pulley 125, toothed belt 116, and upper toothed pulley 115. This, in turn, rotates threaded louver drive rod 114, resulting in synchronized rotation of louver drive gears 113, 222, 223, and 224; offset arms 308, 311, 309, and 303 (see FIG. 15) thereby pivot in unison, causing louvers 108, 111, 109, and 103 to synchronously pivot. As louver drive shaft 117 rotates, it causes outer louvers 108, 109, and 110 to translate in one direction (e.g., toward the east) while causing inner louvers 111 and 103 to translate in the opposite direction (e.g., toward the west), although all of such louvers rotate in the same relative rotational direction. Using the aforementioned synchronous gearing method, the angle of all such louvers is changed in a manner that maintains the orientation of the surfaces of the louvers parallel with one another at all times. Advantageously, louver drive shaft 117 extends through, and forms part of the substantially horizontal pivot axis of the awing frame just above the windows being shaded. As noted above, louver drive 117 shaft can easily be extended to pass through the pivot axes of multiple shade devices arranged in side-by-side fashion, whereby rotation of louver drive shaft 117 simultaneously rotates the louvers supported by each of the multiple shade devices.

Referring again to FIG. 12, louver drive shaft 117 may include one or more coupling connectors 243 along its length for joining together two successive louver drive shafts. In this manner, louver drive shaft 117 may run for the full length of exterior wall 60, or at least that portion of exterior wall 60 that includes windows to be shaded. Thus, in the case of building 102 shown in FIG. 1, for example, louver drive shaft 117 may extend the full length of shade devices 70, 71 and 72, while louver drive shaft 242 may extend the full length of shade devices 67, 68 and 69. In this case, all six of such shade devices have their louver orientation controlled by electric motor 118.

Figure 11:
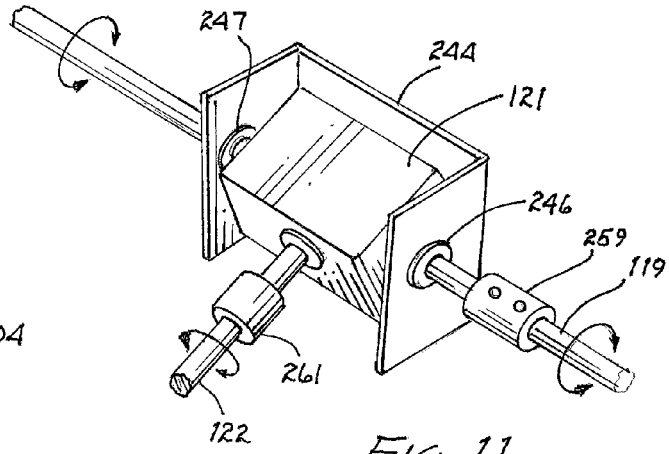
FIG. 11 is a detailed perspective view of a right angle gear box included in the frame drive system.

As noted above, one preferred embodiment of the invention illustrated in FIGS. 1-15 includes the ability to pivot each shade device upwardly or downwardly about its horizontal pivot axis 78. For this purpose, an awning drive shaft 119 is rotatably secured to the exterior of wall 60 of building 102. Preferably, awning drive shaft 119 is supported at a horizontal elevation that is well above louver drive shaft 117. As shown in FIGS. 9 and 11, awning drive shaft 119 is rotatably supported to wall 60 by a series of brackets 244 and 244', one of such brackets being provided adjacent each side of shade device 68. Each such bracket is provided with bushings 246 and 247 inserted into aligned holes of opposing parallel walls for rotatably supporting awning drive shaft 119 therein. In addition, a right angle gear box 121 is inserted within each such bracket 244/244'. As shown in FIG. 11, awning drive shaft 119 is coupled, via coupler 259, to a stub shaft that enters one side of right angle gear box 121. Awning drive shaft 119 effectively extends continuously through right angle gear boxes 121. A threaded screw rod 122 extends downwardly from the right angle port of right angle gear box 121 via coupler 261; as awning drive shaft 119 rotates, threaded screw rod 122 is also caused to rotate. Screw rod 122 extends downwardly to an internally-threaded collar 123 that is pivotally secured to the remote end of connecting arm 127 of triangular frame 104.

As shown in FIG. 9, a reversible electric motor 120 is provided for pivoting the shade devices upwardly and downwardly. Motor 120 rotates a master vertical awning drive shaft 140, which is in turn coupled to a right angle gearbox 249. The right angle port of gearbox 249 drives awning drive shaft 119. Master vertical awning drive shaft extension 250 may extend upwardly from gearbox 249 to another right angle gearbox 251 for driving a second awning drive shaft used to pivot shade devices installed over the windows of a floor of building 102 above.

As awning drive shaft 119 is rotated by motor 120, it causes screw rods 122/122' (see FIG. 9) to rotate, in turn causing the awning frame (i.e., rectangular frame 101 and its attached triangular frames 104/104') to pivot on louver drive shaft 117. Screw rods 122/122' serve to either pull the shade device upwardly, or allow it to pivot downwardly under the force of gravity. When pivoted fully downward, rectangular frame 101 extends directly in front of window 62, and the louvers supported therein extend substantially vertically. When pivoted fully upward, rectangular frame 101 is entirely above the elevation of window 62, and the louvers supported therein extend substantially horizontally.

An electronic control circuit (not shown) is used to control the operation of reversible electric motors 118 and 120 in order to properly angle the louvers to face incident rays of direct sunlight. Such control circuitry may, if desired, be passive, whereby the relative location of the sun is easily determined as a function of the time of day, the time of year, the geographical longitude and latitude of the building, and the direction in which such windows are facing. Accordingly, the desired angle to which the louvers should be directed can be computed using appropriate computer software, and reversible motors 118 and 120 may be controlled accordingly. Alternatively, an active control circuit may be used which actively senses and tracks the position of the sun, if desired. Numerous solar tracking control circuits are commercially available for such purpose. One example of an automated method, using a computerized algorithm, for controlling a pair of motors for maintaining a planar surface aimed at the sun is disclosed in U.S. Pat. No. 7,795,568 to Sherman.

Whether a passive or active control system is used, the louvers track movement of the sun to maintain a perpendicular orientation between the incident rays of direct sunlight and the outwardly-facing surfaces 408, 411, 409, and 403 (see FIG. 15) of louvers 108, 111, 109, and 103. Any direct rays of the sun that pass between outer louvers 108 and 109 strike outer surface 411 of inner louver 111. There will be certain instances when no direct sun rays are striking such louvers; for example, during morning hours for a westerly-facing window, during cloudy days, or when adjacent structures or vegetation serve to shade the windows. Preferably, the electronic control circuit provides an override capability to further maximize the view, and increase entry of natural indirect light in such instances. In this regard, one option is to raise the shade devices, i.e., to pivot them upwardly, as shown in FIG. 1 for shade devices 73-76. If, for some reason, the shade devices can not be raised, a second option is to rotate the louvers in either direction until the outer louvers 108, 109, and 110, and inner louvers 111 and 103 are oriented approximately at right angles to top rail 106 of rectangular frame 101; in this case, each outer louver (e.g., 108) is nested with an adjacent inner louver (e.g., 111), and is located at a distance from the next nearest adjacent pair of nested louvers (e.g., 109 and 103) by almost twice the offset distance (D1 or D2). This position maximizes the amount of natural light passing into window 62, as well as the visibility out of window 62. Ideally, the electronic control device also adjusts the position of the shading device for optimal stability during high wind or other potentially damaging phenomena, as well as for optimal protection of the windows or other parts of the building.

During winter months, and particularly on weekends or holidays, or other times when building 102 is not occupied, the electronic control device may optionally be programmed to either raise the shade devices to their elevated positions, or to rotate the louvers of the shade devices to extend parallel to the sun's rays. The resulting admission of direct sunlight through window 62 thereby helps to heat the interior of building 102.

Figure 18:
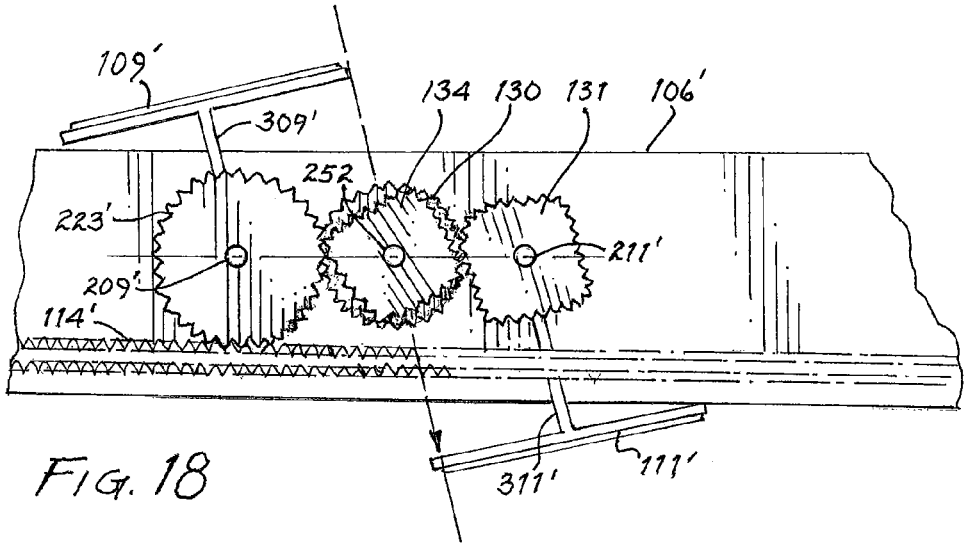
FIG. 18 is a sectional view similar to FIG. 15 but showing an alternate embodiment wherein the inner louvers are rotated by asynchronous gears relative to the outer louvers.

The manner in which the louvers are rotated has been described thus far as a synchronous operation, i.e., the outer louvers and the inner louvers are rotated by the same amount, and at the same rate, as each other. There can be advantages, however, in using an asynchronous method of rotating such louvers. Referring to FIG. 18, components that correspond to those shown in FIG. 15 are designated by similar "primed" reference numerals. Outer louver 109' is rotated by louver drive gear 223' in the same manner as described before. However, inner louver 111' does not have a louver drive gear directly meshed with threaded louver drive rod 114. Instead, an intermediate gear 130 is rotatably supported upon top rail 106 upon axle 252, adjacent to, and meshed with, louver drive gear 223'. Intermediate gear 130 is not meshed with threaded louver drive rod 114. Attached to intermediate gear 130 is a square-shaped gear 134. Another square-shaped gear 131 is rotatably secured to top rail 106 about pivot axis 211', proximate to, and meshed with, square gear 134. Square-shaped gear 131 is, in turn, secured to the offset arm 311' which pivots inner louver 111'.

Figure 21:
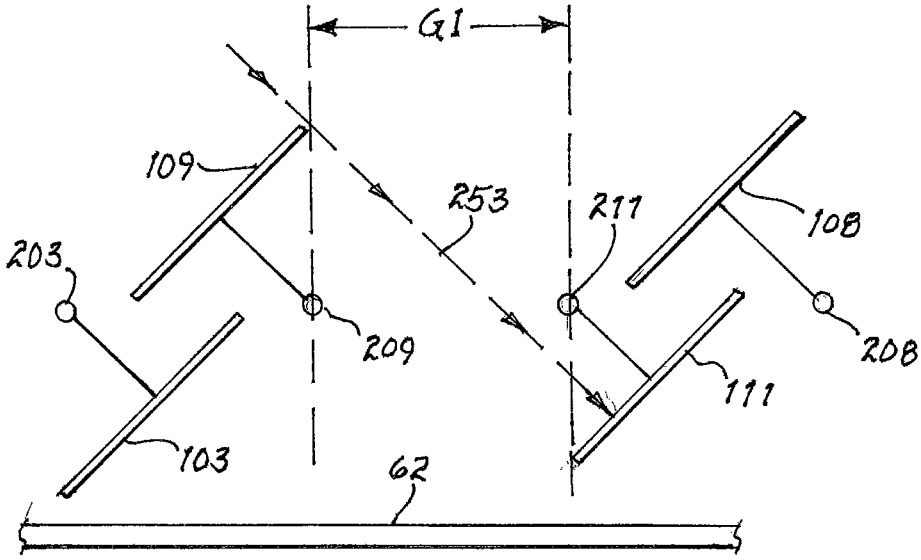
FIG. 21 is a schematic top view of louvers which rotate synchronously to intercept incident sunlight at approximately 9:00 am relative to a southerly-facing window.
Figure 22:
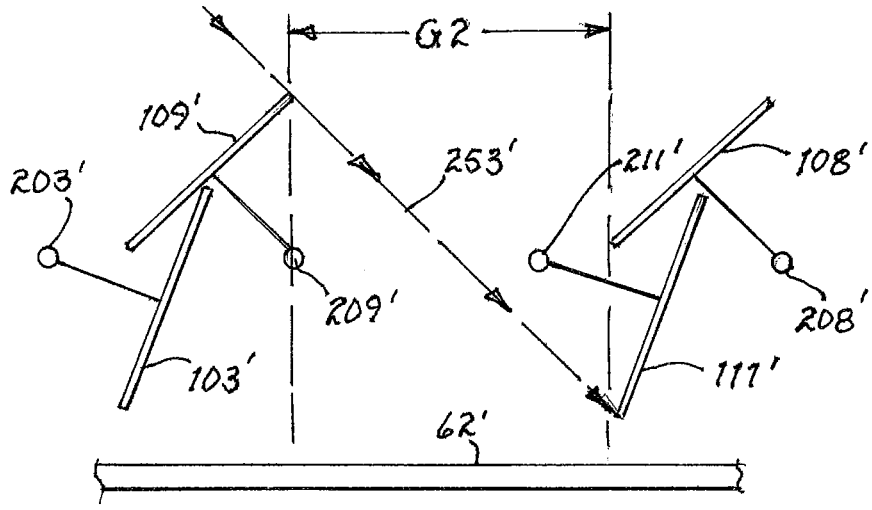
FIG. 22 is a schematic top view, similar to FIG. 21, but showing louvers which rotate asynchronously to intercept incident sunlight under the same conditions specified for FIG. 21.

The advantages of using an asynchronous method of operating the outer and inner louvers is illustrated by the schematic drawings shown in FIGS. 21 and 22. In FIG. 21, outer louvers 108 and 109, and inner louvers 111 and 103, are shown in their usual positions when driven synchronously, as in FIG. 15, and when the sun is incident from approximately a 45 degree angle. All of such louvers extend perpendicular to direct rays of the sun, and parallel to each other. In this case, a person looking directly out window 62 would see a clear line-of sight gap between louver 109 and louver 111 having a width G1. An incident direct ray of sunlight 253 that just passes the edge of outer louver 109 is easily intercepted by inner louver 111. In contrast, in FIG. 22, outer louvers 108' and 109' are shown in their usual positions when the sun is incident from approximately a 45 degree angle, i.e., outer louvers 108' and 109' are perpendicular to the incident direct rays of sunlight. However, inner louvers 111' and 103' have been rotated more than outer louvers 108' and 109' and are no longer parallel thereto. Nonetheless, window 62' is fully-shaded from such direct incident rays of sunlight, as light ray 253' is still intercepted by the edge of inner louver 111'. In this case, however, the person looking directly out window 62' would see a clear line-of sight gap between louver 109' and louvers 108'/111' having a width G2, which is significantly wider than width G1 of FIG. 21. This larger gap also permits a greater amount of indirect light to enter window 62' and light the interior of the building.

Figure 17:
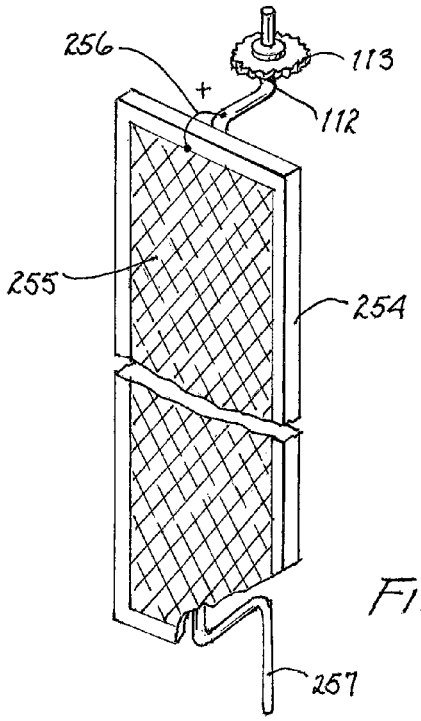
FIG. 17 is a detailed perspective view of a solar panel secured to the outer surface of one of the outer louvers.

Now referring to FIG. 17, a modified form of outer louver 254 is illustrated wherein a photovoltaic panel 255 is mounted upon the outer surface of such outer louver, i.e., the surface which is normally directed toward the sun. Within FIG. 17, plus ("+") and minus (–) symbols are shown to designate the positive and negative electrical terminals of photovoltaic panel 255. If desired, distinct electrical wires can be coupled to the positive and negative terminals of each such photovoltaic panel to connect resulting electrical power to a load or storage battery (not shown). However, it is also possible to use the various components of the shade device to route electrical power to a load or storage battery. In this regard, a first electrically conductive path for generated electrical current includes jumper wire 256 extending from the positive terminal of photovoltaic panel 255 to louver rod 212 (offset arm 308), and to top rail 106 of rectangular frame 101. This path further includes upper connecting leg 127 of triangular frame 104, threaded collar 123, screw rod 122, right angle gear box 121, and awning drive shaft 119 for connection to the positive terminal of a storage battery (not shown). The conductive path for the negative terminal of photovoltaic panel 255 uses the idler offset arm 257 secured to the lower end of louver 254, bottom rail 126 of rectangular frame 101, lower connecting leg 128 of triangular frame 104, louver drive shaft 117 for connection to the negative terminal of such storage battery. In this case, top rail 106 and bottom rail 126 of rectangular frame 101 must be electrically isolated from each other, and upper connecting leg 127 and lower connecting leg of triangular frame 104 must be electrically isolated from each other.

Referring again to FIG. 15, the surfaces of the outer and inner louvers may include reflective surfaces to further enhance the performance of the shading device. For example, the outer surfaces 411 and 403 of inner louvers 111 and 103, respectively, may include a light-colored, or reflective surface, to block all of the direct rays of the sun striking at a 90 degree angle, while allowing such rays to be diffused and reflected off of the inner surfaces 508 and 509 of outer louvers 108 and 109, respectively, for passage into window 62. Alternatively, the outer surfaces 411 and 403 of inner louvers 111 and 103, respectively, may include a fresnel lens with prisms designed to reflect direct rays of the sun striking such outer surfaces. Such fresnel lenses may be backed by a clear frosted material to diffuse any direct rays of the sun that pass through the fresnel lens as a result of imperfections in the prisms.

Still referring to FIG. 15, the inner surfaces 508 and 509 of outer louvers 108 and 109, respectively, may be provided with selective surfaces that maximize the reflection of light within the visible spectrum, and either minimize, or maximize, the emission of light rays in the infrared spectrum. Such surfaces can be utilized to reduce the maximum temperatures attained by the louvers, minimize the radiant heat striking the outside surface of the window 62 and building exterior wall 60, and maximize the light rays within the visible spectrum that are reflected toward the surface of the window 62. Doing so helps to capture diffused light that bounces off of the outer surfaces 411 and 403 of inner louvers 111 and 103, as well as light reflected off of exterior wall 60, and re-direct such light through the window to help illuminate the interior of the building. If desired, the outer surfaces of the inner and/or outer louvers may be light-colored, or reflective, to reflect radiant heat energy that might otherwise build up between the shade device and the exterior of the shaded window.

Figure 19:
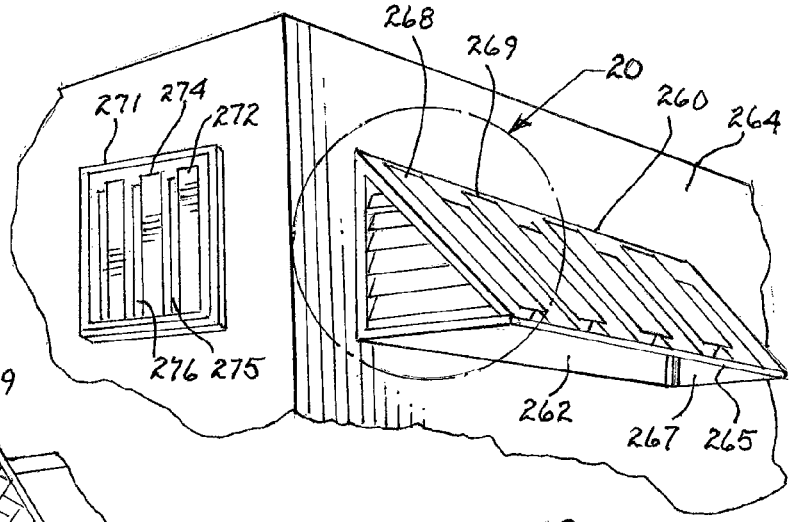
FIG. 19 is a perspective view of a building equipped with two fixed-frame shade devices incorporating two alternate embodiments of the present invention.
Figure 20:
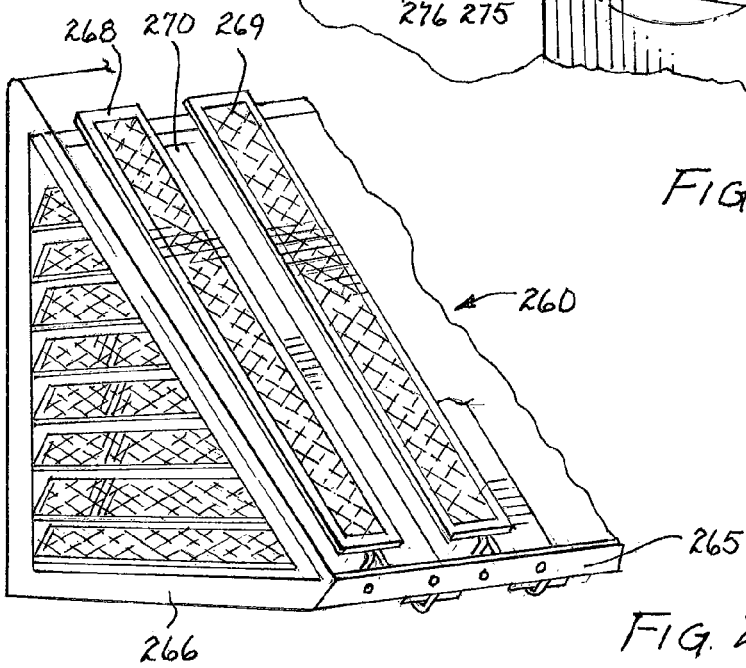
FIG. 20 is an enlarged perspective view of the area enclosed by dashed circle 20 in FIG. 19.

Referring now to FIGS. 19 and 20, an alternate embodiment of the invention is illustrated using a fixed awning frame rather than a pivoting awning frame. Awning frame 260 is installed over window 262, with the upper end of awning frame 260 proximate to exterior wall 264, and lower rail 265 of awning frame spaced apart from window 262 by side supports 266 and 267. As in the case of rectangular frame 101 of FIG. 9, alternating outer louvers 268/269 and inner louvers 270 are rotatably supported in awning frame 260 by offset louver rods for rotating in accordance with the time of day to block direct rays of sunlight, while maximizing the passage of indirect sunlight through window 262, and minimizing the obstruction of the view therethrough. Awning frame 260 maintains louvers 268, 269 and 270 at a fixed angle of inclination, e.g., 45 degrees to a horizontal plane, but facilitates the rotation of such louvers to track east-to-west movement of the sun during each day. A louver motor is still required to rotate the louvers, but no frame pivot motor is required.

As shown in FIG. 19, a further alternate embodiment includes a shade frame 271 placed in a vertical orientation over another window. Vertical outer louvers 272 and 274 are interlaced with vertical inner louvers 275 and 276, and are rotated to block incident direct rays of sunlight. In this embodiment, all of such louvers are supported by fixed frame 271 for rotation about substantially vertical axes.

While FIG. 19 shows shade frame 271 covering a single window for a single floor of a building, those skilled in the art will appreciate that, in a multiple story building, fixed shade frame 271, and louvers 272, 274, 275 and 276, could be lengthened (i.e., extended vertically) to cover two or more windows that are vertically aligned, one above the other, on different floors of the same face of the building. Obviously, the width of shade frame 271, and the number of provided louvers, may be increased to protect windows of greater width.

Figure 23:
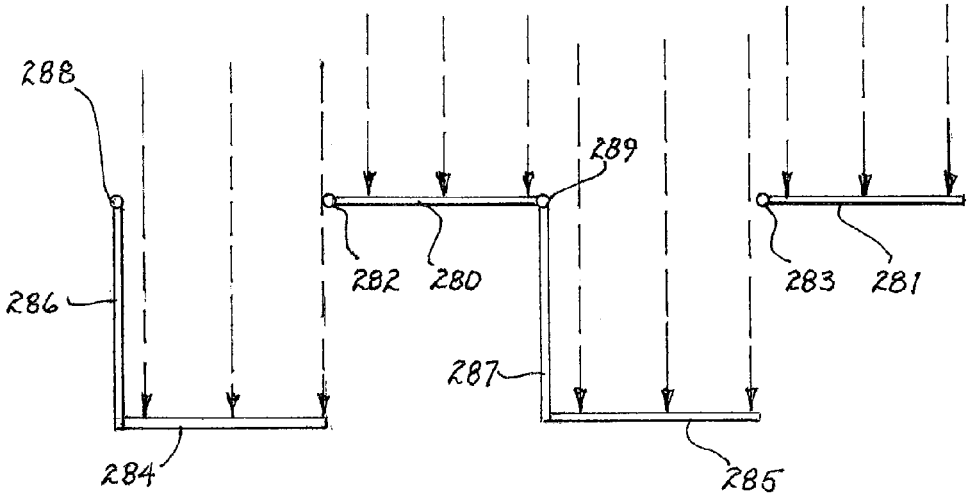
FIG. 23 is a schematic top view of louvers used to block incident rays of sunlight angled perpendicular to the plane of the window in an alternate embodiment, wherein the outer louvers are supported for pivotal rotation about one side edge of such louvers without any offset, while the inner louvers are supported for pivotal rotation by an elongated offset arm secured to one side edge of such inner louvers.
Figure 24:
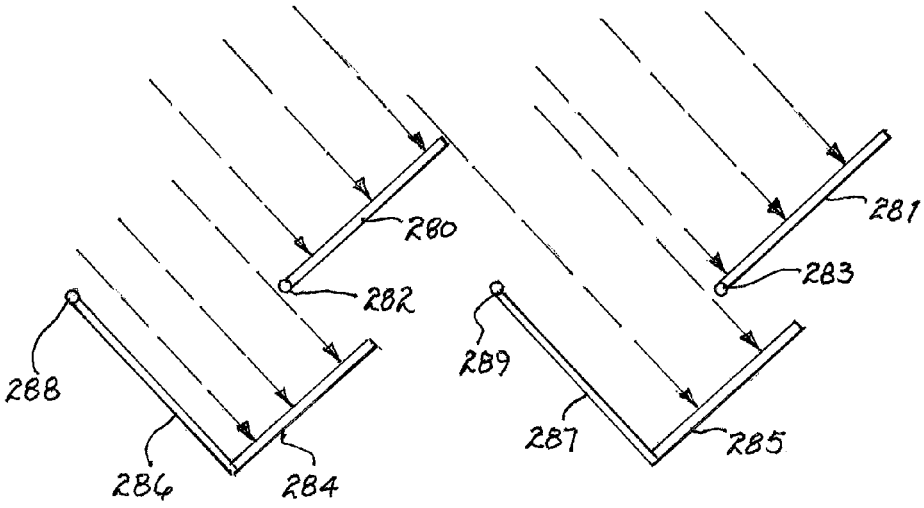
FIG. 24 is a schematic top view of the louvers shown in FIG. 23 rotated to block incident rays of sunlight approaching at an angle of approximately 45 degrees to the plane of the window.

Thus far, the described embodiments have used bent louver rods, or offset arms, to support both the inner louvers and the outer louvers in a manner which displaces the pivot axes away from such louvers. In FIGS. 23 and 24, an alternate embodiment of the present invention is illustrated schematically wherein two outer louvers 280 and 281 pivot about pivot axes 282 and 283, respectively. In this case, pivot axis 282 actually coincides with one edge of louver 280, without any offset arm or louver rod; the offset distance has been reduced to zero. Likewise, pivot axis 283 actually coincides with one edge of louver 281, without any offset arm or louver rod. In contrast, inner louvers 284 and 285 are secured to offset arms 286 and 287 which pivot about pivot axes 288 and 289, respectively. If desired, the relationship illustrated can be reversed, with the inner louvers having zero offset, and wherein the outer louvers are supported by offset arms. As before, outer louvers are interlaced in alternating fashion with the inner louvers. Offset arms 286 and 287 are now longer than in the earlier embodiments, since the offset of outer louvers 280 and 281 has been reduced to zero.

In FIG. 23, incident rays of light are indicated perpendicular to the shaded window, and all of such incident rays are blocked by louvers 280, 281, 284 and 285. In FIG. 24, the incident rays of light now approach from an angle of approximately 45 degrees to the plane of the shaded window, and outer louvers 280 and 281, and inner louvers 284 and 285, have been rotated to extend perpendicular to such incident rays of light. Once again, all of such rays are blocked, and yet a significant clear line-of-sight gap exists, perpendicular to the window, between such louvers, both to maximize the view of the outdoors and to maximize admission of indirect light through the window.

Figure 25:
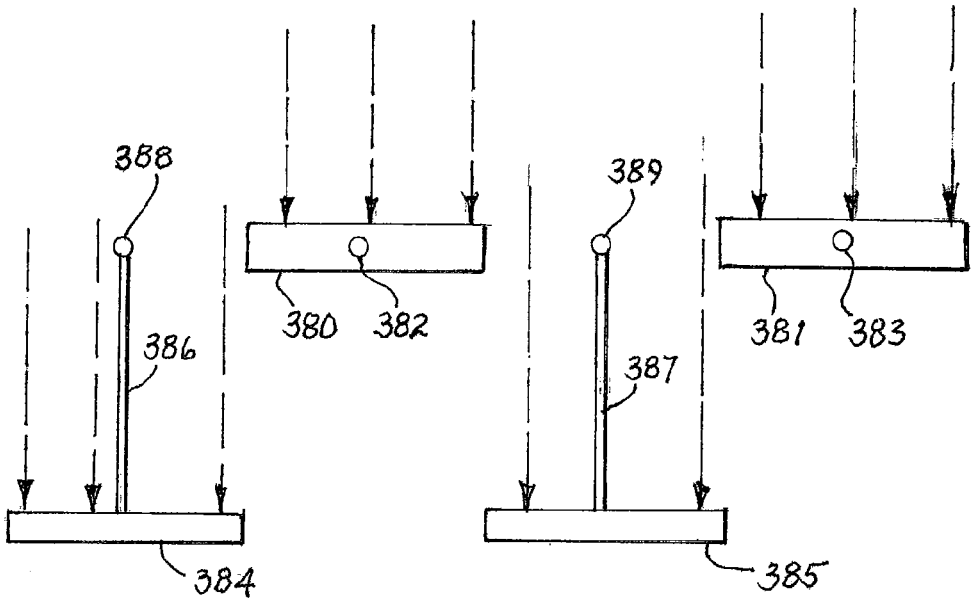
FIG. 25 is a schematic top view of a variation of the embodiment shown in FIGS. 23 and 24, again blocking incident rays of sunlight angled perpendicular to the plane of the window, but wherein the outer louvers are supported for pivotal rotation about their central longitudinal axes without any offset, while the inner louvers are supported for pivotal rotation by an elongated offset arm secured to the central longitudinal axes of such inner louvers.
Figure 26:
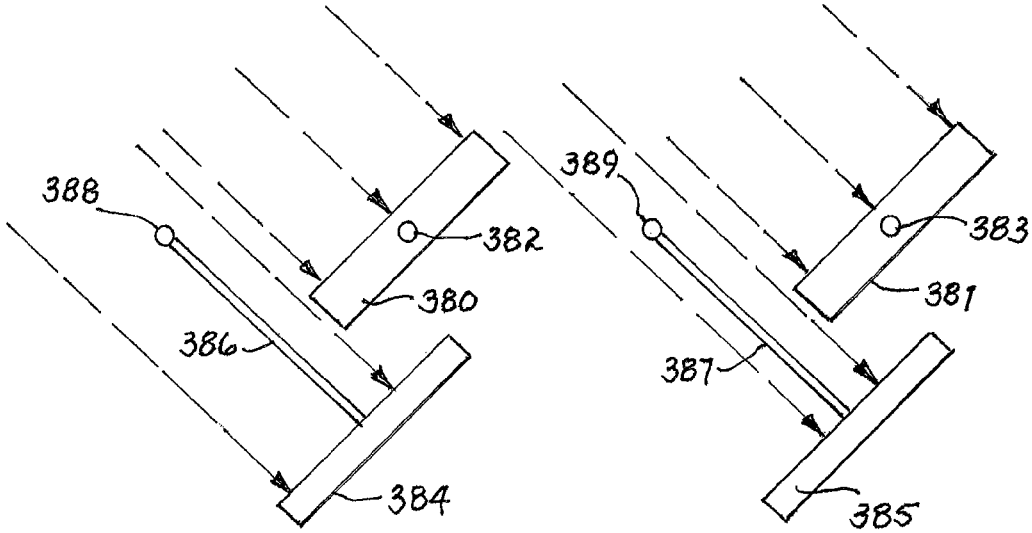
FIG. 26 is a schematic top view of the louvers shown in FIG. 25 rotated to block incident rays of sunlight approaching at an angle of approximately 45 degrees to the plane of the window.

FIGS. 25 and 26 illustrate an alternate embodiment that is a variation of the embodiment described in regard to FIGS. 23 and 24. In FIG. 25, outer louvers 380 and 381, and inner louvers 384 and 385, are again used to block incident rays of sunlight angled perpendicular to the plane of the window. This time, however, outer louvers 380 and 381 are supported for pivotal rotation about their respective central longitudinal axes 382 and 383, without any offset. Inner louvers 384 and 385 are supported for pivotal rotation by respective elongated offset arms 386 and 387. Offset arm 386 pivots about axis 388 at one end, and is secured at its other end to the central longitudinal axis of inner louver 384. Similarly, offset arm 387 pivots about axis 389 at one end, and is secured at its other end to the central longitudinal axis of inner louver 385. In FIG. 26, outer louvers 380 and 381, and inner louvers 384 and 385 have been rotated to block incident rays of sunlight approaching at an angle of approximately 45 degrees to the plane of the window. It will be appreciated that the above-described relationship may be reversed, i.e., inner louvers 384 and 385 could be directly rotated about their central longitudinal axes without any offset, while outer louvers 380 and 381 could be pivoted by offset arms secured to such outer louvers along their respective central longitudinal axes.

Those skilled in the art will now appreciate that an improved shade apparatus has been described for shading a window of a building from the sun. The described shade device effectively shades direct rays of the sun from passing into a window while minimizing interference of an occupant's view of the exterior through such window. The disclosed shade device further maximizes the passage of indirect ambient light through the window to help illuminate the interior space. The shade device is easily controlled to effectively shade direct sunlight from entering a building window during substantially all hours of the day, and during substantially all seasons of the year. Moreover, the described shade apparatus is relatively simple and inexpensive, and avoids any modification of windows already existing in a building. In addition, the disclosed shade device can be assembled in modular form to synchronously shade a large number of windows in a relatively large commercial building. Further, photovoltaic panels may be provided on the outer faces of the outer louvers to face, and track, the sun throughout the day.

While the present invention has been described with respect to preferred embodiments thereof, such description is for illustrative purposes only, and is not to be construed as limiting the scope of the invention. For example, while the above-described preferred embodiment identifies a particular mechanical coupling for transmitting rotational motion from 117 to arms 308, 311, 309 and 303, other known mechanical coupling components may be used for this purpose, including right angle gears, rotating shafts, racks and pinions, tie rods, cables, pulleys, chains, belts, clutches, levers, and other devices commonly used for transmitting power. Indeed, one could provide an electrical stepping motor within the frame of each awning shade device to rotate louver drive worm shaft 114 for controlling the outer and inner louvers, and eliminate toothed belt 116 (see FIGS. 13 and 14), toothed pulley 125 (see FIG. 13), toothed pulley 115 (see FIG. 14), and louver drive shaft 117; a pair of electrical wires would then be routed to each awning frame to control the electrical stepping motor housed within each such frame. Various other modifications and changes may be made to the described embodiments by those skilled in the art without departing from the true spirit and scope of the invention as defined by the appended claims.

We claim:

1. An apparatus for shading a first window of a building from the sun, the building having an exterior, and the first window having a top, the apparatus comprising in combination:

a. a first awning frame having first and second opposing ends, the first end of the first awning frame being pivotally connected to the exterior of the building above the first window, the first awning frame pivoting about a substantially horizontal axis, said horizontal axis being proximate to the top of the first window, the second end of the first awning frame being spaced apart from the first end of the first awning frame and spaced apart from the first window;

b. a frame drive system coupled to the exterior of the building and coupled to the first awning frame, the frame drive system selectively causing the second end of the first awning frame to pivot upwardly or downwardly about the first end of the first awning frame in accordance with a current position of the sun;

c. a plurality of louvers, each of the plurality of louvers being disposed proximate the second end of the first awning frame, and each louver within the plurality of louvers being rotatably supported about its own pivot axis relative to the second end of the first awning frame, the pivot axes of the plurality of louvers each being substantially perpendicular to the substantially horizontal pivot axis of the first awning frame, the plurality of louvers including a plurality of inner louvers and a plurality of outer louvers, the plurality of inner louvers generally being disposed closer to the first window than the plurality of outer louvers; and d. a louver drive system supported at least in part by the first awning frame and coupled to the plurality of louvers for selectively rotating the plurality of louvers in accordance with the position of the sun.

2. The apparatus recited by claim 1 wherein:

a. each louver within the plurality of louvers has its own longitudinal panel axis, the longitudinal panel axes of the plurality of louvers being substantially parallel to each other; and b. the pivot axes of the plurality of louvers being substantially parallel to each other and substantially parallel to the longitudinal panel axes.

3. The apparatus recited by claim 2 wherein the longitudinal axes of the plurality of louvers are substantially perpendicular to the substantially horizontal pivot axis of the first awning frame.

4. The apparatus recited by claim 1 wherein the plurality of inner louvers and the plurality of outer louvers all have the same width (W).

5. The apparatus recited by claim 1 wherein at least one of the outer louvers includes a photovoltaic panel generally facing away from the first window of the building.

6. The apparatus recited by claim 1 wherein the plurality of inner louvers and the plurality of outer louvers are supported at the second end of the first awning frame in alternating positions with each other to provide a staggered configuration of louvers.

7. The apparatus recited by claim 1 wherein each of the plurality of inner louvers rotates about its own pivot axis, the pivot axes of the plurality of inner louvers being substantially parallel to each other, and the pivot axes of the plurality of inner louvers lying substantially within a common plane.

8. The apparatus recited by claim 1 wherein each of the plurality of outer louvers rotates about its own pivot axis, the pivot axes of the plurality of outer louvers being substantially parallel to each other, and the pivot axes of the plurality of outer louvers lying substantially within a common plane.

9. The apparatus recited by claim 8 wherein each of the plurality of inner louvers rotates about its own pivot axis, the pivot axes of the plurality of inner louvers being substantially parallel to each other, and the pivot axes of the plurality of inner louvers lying substantially coplanar with the pivot axes of the plurality of outer louvers.

10. The apparatus recited by claim 8 wherein the plurality of inner louvers and the plurality of outer louvers are supported at the second end of the first awning frame in alternating positions with each other to provide a staggered configuration of louvers.

11. The apparatus recited by claim 1 wherein:

a. each of the plurality of inner louvers rotates about its own pivot axis;

b. each of the plurality of outer louvers rotates about its own pivot axis;

c. the plurality of outer louvers includes first and second successive outer louvers;

d. the pivot axis of the first outer louver lies in a first plane substantially perpendicular to the substantially horizontal pivot axis of the first awning frame;

e. the pivot axis of the second outer louver lies in a second plane substantially perpendicular to the substantially horizontal pivot axis of the first awning frame;

f. the plurality of inner louvers includes an intermediate louver lying proximate to the first and second successive outer louvers;

g. the pivot axis of the intermediate louver lies in a third plane substantially perpendicular to the substantially horizontal pivot axis of the first awning frame; and h. the third plane lies substantially midway between the first and second planes.

12. The apparatus recited by claim 1 wherein the frame drive system includes a rotatable threaded rod, and wherein said rotatable threaded rod is threadedly engaged by the second end of the awing frame, whereby rotation of the rotatable threaded rod in a first direction pivots the second end of the first awning frame upward, and rotation of the rotatable threaded rod in an opposing second direction pivots the second end of the first awning frame downward.

13. The apparatus recited by claim 12 wherein the frame drive system further includes:

a. a driveshaft rotatably coupled to the exterior of the building; and b. a gearbox having an input for receiving the driveshaft and having an output for coupling to said rotatable threaded rod;

whereby rotation of the driveshaft causes rotation of said rotatable threaded rod.

14. The apparatus recited by claim 13 wherein the driveshaft is disposed above the first window, the driveshaft extending generally parallel to the substantially horizontal axis of the first awning frame.

15. The apparatus recited by claim 1 wherein the building includes a second window, the apparatus further comprising:

a. a second awning frame having first and second opposing ends, the first end of the second awning frame being pivotally connected to the exterior of the building above the second window, the second awning frame pivoting about a substantially horizontal axis, said horizontal axis being proximate to the top of the second window;

b. the second awning frame including a further plurality of louvers, each of the further plurality of louvers being rotatably supported proximate the second end of the second awning frame; and c. the frame drive system being coupled to the second awning frame for selectively causing the second end of the second awning frame to pivot upwardly or downwardly in accordance with the position of the sun.

16. The apparatus recited by claim 15 wherein the frame drive system includes a driveshaft mechanically coupled to the first awning frame and to the second awning frame, and wherein rotation of said driveshaft simultaneously pivots the first and second awning frames.

17. The apparatus recited by claim 15 wherein the first and second windows are arranged side-by-side.

18. The apparatus recited by claim 17 wherein the first and second windows are substantially contiguous.

19. The apparatus recited by claim 15 wherein the first and second windows are arranged one above the other.

20. The apparatus recited by claim 1 wherein the louver drive system includes a rotatable drive shaft mechanically coupled with the plurality of louvers.

21. The apparatus recited by claim 20 wherein the rotatable drive shaft has a central axis of rotation, and wherein the rotatable drive shaft is coaxial with the substantially horizontal pivot axis of the awing frame.

22. The apparatus recited by claim 1 wherein the building includes a second window, the apparatus further comprising:

a. a second awning frame having first and second opposing ends, the first end of the second awning frame being pivotally connected to the exterior of the building above the second window, the second awning frame pivoting about a substantially horizontal axis, said horizontal axis being proximate to the top of the second window;

b. the second awning frame including a further plurality of louvers, each of the further plurality of louvers being rotatably supported proximate the second end of the second awning frame; and c. the louver drive system includes a driveshaft mechanically coupled to:

i. the plurality of louvers rotatably supported proximate the second end of the first awning frame; and ii. the further plurality of louvers rotatably supported proximate the second end of the second awning frame;

wherein rotation of said driveshaft simultaneously rotates the plurality of louvers supported by the first awning frame and the further plurality of louvers supported by the second awning frame.

23. The apparatus recited by claim 22 wherein the first and second windows are arranged side-by-side.

24. The apparatus recited by claim 23 wherein the first and second windows are substantially contiguous.

25. The apparatus recited by claim 23 wherein the rotatable drive shaft has a central axis of rotation, and wherein the rotatable drive shaft is coaxial with the substantially horizontal pivot axes of the first and second awing frames.

26. The apparatus recited by claim 22 wherein the first and second windows are arranged one above the other.

27. The apparatus recited by claim 1 wherein:

a. at least one of the plurality of louvers includes an inner surface that generally faces the first window and an opposing outer surface; and b. a photovoltaic panel secured to the outer surface of said at least one louver for generating electricity when illuminated.

28. The apparatus recited by claim 27 wherein the first awning frame includes portions that are electrically conductive, wherein the photovoltaic panel generates an electrical current, and wherein the electrical current generated by the photovoltaic panel is conducted, at least in part, by the first awning frame.

29. The apparatus recited by claim 1 wherein at least one of the plurality of louvers includes an inner surface that generally faces the first window, said inner surface being reflective to reflect light toward the first window.

30. The apparatus recited by claim 29 wherein at least one of the plurality of louvers includes an outer surface that generally faces away from the first window, said outer surface being reflective to reflect light away from the first window.

31. The apparatus recited by claim 1 wherein at least one of the plurality of inner louvers includes an outer surface that generally faces away from the first window, said outer surface being reflective to reflect light toward the outer louvers.

32. The apparatus recited by claim 31 wherein at least one of the plurality of outer louvers includes an inner surface that generally faces the first window, said inner surface being reflective to reflect light toward the first window.

33. An apparatus for shading at least one window of a building from the sun, the building having an exterior, the at least one window having an uppermost edge extending along a substantially horizontal window axis the apparatus comprising in combination:

a. a frame coupled to the exterior of the building proximate to the at least one window;

b. a plurality of outer louvers rotatably supported by the frame, each such outer louver being rotatable about its own pivot axis;

c. a plurality of inner louvers rotatably supported by the frame each such inner louver being rotatable about its own pivot axis, the plurality of inner louvers generally being disposed closer to the at least one window than the plurality of outer louvers;

d. the pivot axes of each of the plurality of outer louvers, and the pivot axes of each of the plurality of inner louvers, being substantially perpendicular to the substantially horizontal window axis; and e. a louver drive system supported at least in part by the frame and coupled to the plurality of outer louvers and to the plurality of inner louvers for selectively rotating the plurality of outer louvers and the plurality of inner louvers in accordance with a position of the sun.

34. The apparatus recited by claim 33 wherein the plurality of outer louvers and the plurality of inner louvers are supported by the frame in alternating positions with each other to provide a staggered configuration of louvers.

35. The apparatus recited by claim 34 wherein the plurality of outer louvers and the plurality of inner louvers are supported by the frame for rotation about substantially vertical axes.

36. The apparatus recited by claim 34 wherein:

a. each of the plurality of outer louvers includes an elongated panel having a longitudinal panel axis;

b. each of the plurality of outer louvers is supported by at least one offset arm for rotational movement relative to the frame about a pivot axis, the pivot axis being offset from the longitudinal panel axis by a first offset arm distance (D1);

c. each of the plurality of inner louvers includes an elongated panel having a longitudinal panel axis;

d. each of the plurality of inner louvers is supported by at least one offset arm for rotational movement relative to the frame about a pivot axis, the pivot axis being offset from the longitudinal panel axis by a second offset arm distance (D2).

37. The apparatus recited by claim 36 wherein the pivot axes of the plurality of outer louvers and the pivot axes of the plurality of inner louvers all lie in a common plane.

38. The apparatus recited by claim 36 wherein:

a. the pivot axis of each inner louver is located substantially between the pivot axes of adjacent preceding and succeeding outer louvers;

b. the pivot axis of each inner louver is separated from the pivot axes of the adjacent preceding and succeeding outer louvers by separation distance (S); and c. the sum of the first offset arm distance (D1) and the second offset arm distance (D2) is greater than the separation distance (S).

39. The apparatus recited by claim 36 wherein:

a. the pivot axes of the plurality of outer louvers lie in a common plane; and b. the pivot axes of the plurality of inner louvers lie in a common plane.

40. The apparatus recited by claim 39 wherein each of the plurality of outer louvers and each of the plurality of inner louvers are of substantially the same width (W).

41. The apparatus recited by claim 40 wherein:

a. the pivot axis of each inner louver is located substantially between the pivot axes of adjacent preceding and succeeding outer louvers;

b. the pivot axis of each inner louver is separated from the pivot axes of the adjacent preceding and succeeding outer louvers by a separation distance (S); and c. the width (W) of each of the plurality of outer louvers and each of the plurality of inner louvers is greater than the separation distance (S).

42. The apparatus recited by claim 39 wherein each of the plurality of outer louvers has a width (W1) and each of the plurality of inner louvers has a width (W2).

43. The apparatus recited by claim 42 wherein:

a. the pivot axis of each inner louver is located substantially between the pivot axes of adjacent preceding and succeeding outer louvers;

b. the pivot axis of each inner louver is separated from the pivot axes of the adjacent preceding and succeeding outer louvers by separation distance (S); and c. the sum of the widths (W1) and (W2) is greater than twice the separation distance (S).

44. The apparatus recited by claim 40 wherein successive pivot axes of the plurality of outer louvers are separated from each other by a distance substantially equal to twice the width (W).

45. The apparatus recited by claim 44 wherein successive pivot axes of the plurality of inner louvers are separated from each other by a distance substantially equal to twice the width W (W).

46. The apparatus recited by claim 45 wherein the first offset arm distance is substantially equal to the second offset arm distance.

47. The apparatus recited by claim 33 wherein said louver drive system rotates the plurality of inner louvers asynchronously relative to the plurality of outer louvers.

48. The apparatus recited by claim 33 wherein at least one of the plurality of outer louvers includes a photovoltaic panel generally facing away from the at least one window of the building.

49. The apparatus recited by claim 48 wherein the frame includes portions that are electrically conductive, wherein the photovoltaic panel generates an electrical current, and wherein the electrical current generated by the photovoltaic panel is conducted, at least in part, by the frame.

50. The apparatus recited by claim 33 wherein each of the plurality of outer louvers includes an inner surface that generally faces the at least one window, the inner surfaces of the plurality of outer louvers being reflective.

51. The apparatus recited by claim 33 wherein each of the plurality of outer louvers includes an outer surface that generally faces away from the at least one window, the outer surfaces of the plurality of outer louvers being reflective.

52. The apparatus recited by claim 33 wherein each of the plurality of inner louvers includes an inner surface that generally faces the at least one window, the inner surfaces of the plurality of inner louvers being reflective.

53. The apparatus recited by claim 33 wherein each of the plurality of inner louvers includes an outer surface that generally faces away from the at least one window, the outer surfaces of the plurality of inner louvers being reflective.

54. The apparatus recited by claim 33 wherein the frame is pivotally connected to an exterior portion of the building above the at least one window about a substantially horizontal pivot axis, said substantially horizontal pivot axis being proximate to the substantially horizontal window axis.

55. The apparatus recited by claim 54 including a frame drive system coupled to the frame for selectively causing the frame to pivot generally upwardly or downwardly in accordance with the position of the sun.

56. The apparatus recited by claim 34 wherein:

a. each of the plurality of outer louvers includes an elongated panel having a longitudinal panel axis; and each of the plurality of inner louvers includes an elongated panel having a longitudinal panel axis.

57. The apparatus recited by claim 56 wherein:

a. the longitudinal panel axis and the pivot axis for each outer louver are separated from each other by an offset distance (D1), which offset distance may be zero;

b. the longitudinal panel axis and the pivot axis for each inner louver are separated from each other by an offset distance (D2), which offset distance may be zero;

c. the pivot axis of each inner louver is located substantially between the pivot axes of adjacent preceding and succeeding outer louvers;

d. the pivot axis of each inner louver is separated from the pivot axes of the adjacent preceding and succeeding outer louvers by separation distance (S); and e. the sum of the offset distance (D1) and offset distance (D2) is greater than the separation distance (S), for enabling adjacent louvers to overlap one another.

58. The apparatus recited by claim 57 wherein:

a. the offset distance (D1) is zero;

b. the longitudinal panel axis and pivot axis for each outer louver are coincident with each other;

c. the pivot axis for each inner louver is displaced from the longitudinal panel axis of each such inner louver by offset distance (D2); and d. offset distance (D2) exceeds separation distance (S).

59. The apparatus recited by claim 57 wherein:

a. the offset distance (D2) is zero;

b. the longitudinal panel axis and pivot axis for each inner louver are coincident with each other;

c. the pivot axis for each outer louver is displaced from the longitudinal panel axis of each such outer louver by offset distance (D); and d. offset distance (D1) exceeds separation distance (S).

60. The apparatus recited by claim 33 wherein the building includes a second window, the apparatus further comprising:

a. a second frame coupled to the exterior of the building proximate to the second window;

b. a second plurality of outer louvers rotatably supported by the second frame;

c. a second plurality of inner louvers rotatably supported by the second frame, the second plurality of inner louvers generally being disposed closer to the second window than the second plurality of outer louvers; and d. the louver drive system is supported at least in part by the second frame and coupled to the second plurality of outer louvers and to the second plurality of inner louvers for selectively rotating the second plurality of outer louvers and the second plurality of inner louvers in accordance with the position of the sun.

61. The apparatus recited by claim 60 wherein the louver drive system includes a driveshaft mechanically coupled to:

i. the plurality of outer louvers rotatably supported proximate to the at least one window;

ii. the plurality of inner louvers rotatably supported proximate to the at least one window;

iii. the second plurality of outer louvers rotatably supported proximate to the second window; and iv. the second plurality of inner louvers rotatably supported proximate to the second window;

wherein rotation of said driveshaft simultaneously rotates the plurality of outer louvers and the plurality of inner louvers supported proximate to the at least one window, as well as the second plurality of outer louvers and the second plurality of inner louvers rotatably supported proximate to the second window.

62. The apparatus recited by claim 60 wherein the at least one window and the second window are arranged side-by-side.

63. The apparatus recited by claim 60 wherein the at least one window and the second window are arranged one above the other.

* * * * *